US008474624B2

(12) United States Patent
Cronin et al.

(10) Patent No.: US 8,474,624 B2
(45) Date of Patent: Jul. 2, 2013

(54) CHILD RESISTANT CONTAINER

(75) Inventors: Edward P. Cronin, Brodhead, WI (US); Michael K. Basak, Belvidere, IL (US)

(73) Assignee: J.L. Clark, Inc., Rockford, IL (US)

( * ) Notice: Subject to any disclaimer, the term of this patent is extended or adjusted under 35 U.S.C. 154(b) by 0 days.

(21) Appl. No.: 13/427,143

(22) Filed: Mar. 22, 2012

(65) Prior Publication Data

US 2012/0261418 A1 Oct. 18, 2012

Related U.S. Application Data

(63) Continuation-in-part of application No. 13/087,990, filed on Apr. 15, 2011.

(51) Int. Cl.
*B65D 83/04* (2006.01)
*B65D 85/42* (2006.01)

(52) U.S. Cl.
USPC ..... 206/540; 206/528; 206/1.5; 220/277; 220/281

(58) Field of Classification Search
USPC ..... 206/540, 528, 532, 1.5; 220/660, 220/522, 521, 277, 254.9, 254.1, 259.5, 256.1; 229/125.125
See application file for complete search history.

(56) References Cited

U.S. PATENT DOCUMENTS

| | | | | | |
|---|---|---|---|---|---|
| 2,353,629 | A * | 7/1944 | Apfelbaum | 206/536 |
| 3,888,350 | A * | 6/1975 | Horvath | 206/531 |
| 3,949,898 | A * | 4/1976 | Patel et al. | 220/277 |
| 4,113,098 | A * | 9/1978 | Howard | 206/540 |
| 4,364,488 | A * | 12/1982 | Anjou | 220/281 |
| 4,401,210 | A | 8/1983 | Anjou | |
| 4,591,074 | A * | 5/1986 | Kennings | 222/153.01 |
| 6,953,131 | B2 * | 10/2005 | Devine | 221/246 |
| 7,086,556 | B1 | 8/2006 | Trulove-Cranor | |
| 7,882,953 | B2 * | 2/2011 | Heller et al. | 206/499 |
| 8,091,709 | B2 * | 1/2012 | Gnepper | 206/536 |
| 2004/0055903 | A1 * | 3/2004 | Nishimura | 206/1.5 |
| 2007/0284277 | A1 * | 12/2007 | Gnepper | 206/528 |
| 2009/0266837 | A1 * | 10/2009 | Gelardi et al. | 221/154 |
| 2011/0036743 | A1 | 2/2011 | Wharton | |
| 2011/0067363 | A1 | 3/2011 | Sprada et al. | |

FOREIGN PATENT DOCUMENTS

JP 2003192055 A 7/2003

* cited by examiner

*Primary Examiner* — Mickey Yu
*Assistant Examiner* — Chun Cheung
(74) *Attorney, Agent, or Firm* — Reinhart Boerner Van Deuren P.C.

(57) ABSTRACT

A container and method of opening a container are provided. The container includes a dispensing cartridge defining a storage cavity with an access opening. A blocking member is transitionable from a blocked state to an unblocked state relative to the access opening. The blocking member covers a greater portion of the access opening in the blocked state than in the unblocked state. The outer shell includes a piercing mechanism configured to transition the blocking member from the blocked state to the unblocked state. The method includes using the piercing mechanism to transition the blocking member from the blocked state to the unblocked state.

20 Claims, 17 Drawing Sheets

CHILD RESISTANT CONTAINER

CROSS-REFERENCE TO RELATED PATENT APPLICATIONS

This patent application is a continuation-in-part of co-pending U.S. patent application No. 13/087,990, filed Apr. 15, 2011, the entire teachings and disclosure of which are incorporated herein by reference thereto.

FIELD OF THE INVENTION

This invention generally relates to containers, and more particularly, to handheld containers for product such as candy, medicine, vitamins or other small objects.

BACKGROUND OF THE INVENTION

Containers for storing various medicines are required to be child resistant. This requirement is used to prevent children from accidentally ingesting the contents of the containers. One test that determines whether or not a container is considered child resistant is if opening the container requires a multi-step process. For instance, some child resistant containers have threaded lids that require a two-step process to remove the threaded lid from the container bottom. The two step process requires first axially pressing the threaded lid toward the container bottom and then second rotationally twisting the threaded lid relative to the container bottom. Here, the first step is axially pressing and the second step is rotationally twisting (i.e. unthreading).

One problem in designing child resistant containers is making the containers child resistant but still making the containers accessible for the elderly or disabled. It is often difficult for the disabled or elderly to grip containers strong enough to perform the two separate necessary steps.

It is also beneficial to provide tamper evidence for containers to determine if the internal storage area of the container has been accessed prior to purchase.

The present invention relates to improvements in the container art generally and in particular embodiments to child resistant containers.

BRIEF SUMMARY OF THE INVENTION

Embodiments of the present invention provide new and improved containers. The new and improved containers provide a new and improved mechanism/arrangement for securing the container in a closed state and transitioning the container to an open state. In some instances, the mechanism can provide child resistance features such that the containers can be used for medicine.

In one embodiment, the container comprises an outer shell, a dispensing cartridge and a cooperating catch arrangement. The outer shell defining an opening. The dispensing cartridge defines a storage cavity and an access opening to the storage cavity. The dispensing cartridge is slidable within the outer shell between a closed state in which the access opening is closed by the outer shell prohibiting access to the storage cavity and an open state in which the access opening is open such that access to the storage cavity through the opening is permitted. The cooperating catch arrangement is operably interposed between the outer shell and the dispensing cartridge. The cooperating catch arrangement has a locked state that fixes the dispensing cartridge in the closed state relative to the outer shell and an unlocked state in which the dispensing cartridge is permitted to slide relative to the outer shell from the closed state to the open state. The cooperating catch arrangement is configured to be transitionable from the locked state to the unlocked state by resiliently reducing a width of the outer shell along a compression axis which resiliently expands a thickness of the outer shell along an expansion axis to disengage cooperating catch arrangement.

In one embodiment, the outer shell has opposed side portions. Each opposed side portion has a curved portion that bows outward and away from the other side in a relaxed state.

In one embodiment, the outer shell has opposed side portions that are formed between opposed edge portions. The width is defined between the opposed edge portions. Each side portion has a curved portion extending outward and away from the other one of the opposed sides.

In one embodiment, the outer shell has a pair of convex sidewall portions that generally define the width. The maximum width is preferably substantially at a midway point between the edges/edge portions of the outer shell. More particularly, in one embodiment, the sidewall portions extend between opposed edge portions of the outer shell. The convex sidewall portions bowing outward and away from one another such that the thickness of the outer shell at the edge portions is less than the thickness of the outer shell between and spaced from the edge portions.

In one embodiment, a stop arrangement is provided between the outer shell and the dispensing cartridge. The stop arrangement acts to limit the amount of relative sliding travel between the outer shell and the dispensing cartridge such that the dispensing cartridge is inhibited from being fully removed from the outer shell during normal operation. However, the dispensing cartridge can be removed from the outer shell under significant loading.

In one embodiment, the stop arrangement includes a channel having an abutment end and an abutment projection slidably positioned within the channel. The abutment projection axially abutting the abutment end at an end of the relative sliding travel inhibiting removal of the dispensing cartridge from the outer shell. In one embodiment, the channel does not extend entirely through the sidewall of the outer shell.

In another embodiment, the stop arrangement includes first and second abutments. The first and second abutments axially abut to limit the amount of relative sliding travel between the outer shell and the storage compartment to inhibit removal of the dispensing cartridge from the outer shell during normal operation. The cap of the container and a top/distal end of the sidewall portion of the outer shell may form a second limit that limits the amount of axial relative motion of the outer shell and the storage cartridge. These will abut when then the storage cartridge is fully inserted into the outer shell.

In a further embodiment, a container comprising an outer shell, a dispensing cartridge and a cooperating catch arrangement is provided. The dispensing cartridge is slidably carried within the outer shell between an open position in which access is permitted to a storage region of the container and a closed position in which access is prevented to the storage region by the outer shell. The cooperating catch arrangement is operably interposed between the outer shell and the dispensing cartridge. The cooperating catch arrangement has a locked state that fixes the dispensing cartridge relative to the outer shell in the closed position and an unlocked state in which the dispensing cartridge is permitted to slide relative to the outer shell from the closed position to the open position. The outer shell is resiliently compressible along a compression axis in such a manner that at least one side portion of the outer shell resiliently flexes along an expansion axis to transition the cooperating catch arrangement from the locked state to the unlocked state.

In one embodiment, the compression axis is generally perpendicular to the expansion axis.

In one embodiment, an outer surface of the at least one side portion is generally convex when the outer shell is in a relaxed state. The convex shape directs the flexing of the at least one side portion outward along the expansion axis of the at least one side portion when the outer shell is resiliently compressed along the compression axis.

In a more particular embodiment, the compression axis is generally parallel to a width of outer shell and the expansion axis is generally parallel to a thickness of the outer shell. Preferably, the width of the outer shell is greater than the thickness of the outer shell proximate the cooperating catch arrangement.

A method of opening a container comprising an outer shell and a dispensing cartridge carried within the outer shell is also provided. The method includes squeezing/compressing the outer shell along a compression axis causing a catch arrangement between the outer shell and the dispensing cartridge to disengage along an expansion axis that is non-parallel with the compression axis.

In one method, the method further includes axially pulling the dispensing cartridge along a sliding axis that is non-parallel to the compression and expansion axes. The step of pulling occurs after or simultaneous with, but not before, the step of squeezing/compressing.

In one method, the compression, expansion and sliding axes extend at angles of between about 80 and 100 degrees relative to one another. In a more particular embodiment, the compression, expansion and sliding axes are substantially perpendicular to one another.

In one method, the method further includes biasing the dispensing cartridge along a sliding axis that is non-parallel to the compression and expansion axes with a biasing mechanism.

In another embodiment, a container comprising a dispensing cartridge, a blocking member and an outer shell is provided. The dispensing cartridge defines a storage cavity and an access opening to the storage cavity. The blocking member is transitionable from a blocked state relative to the access opening to an unblocked state relative to the access opening. The blocking member covers a greater portion of the access opening in the blocked state than in the unblocked state such that larger objects can pass through the access opening when the blocking member is in the unblocked state than when in the blocked state. This does not require that objects can even pass through in the blocked state. The outer shell includes a piercing mechanism configured to transition the blocking member from the blocked state to the unblocked state. The dispensing cartridge is slidable within the outer shell between a closed state and an open state. In the closed state, a cover portion of the outer shell overlaps the access opening. The cover portion inhibits access to the storage cavity when the blocking member is in the unblocked state. In the open state, the cover portion of the outer shell overlaps the access opening to a lesser extent to increase access to the storage cavity through the opening when the blocking member is in the unblocked state.

In one embodiment, the blocking member completely prevents passage through the access opening in the blocked state.

In one embodiment, the blocking member is formed as a portion of the dispensing cartridge. The blocking member is attached to the rest of the dispensing cartridge by a thin web of material. When the blocking member is transitioned to the unblocked state for a first time, at least a portion of the thin web of material is permanently broken.

In one embodiment, the thin web of material further includes a thickened hinge portion that is not permanently broken when the blocking member is transitioned to the unblocked state for, at least, the first time. In one embodiment, the blocking member pivots relative to the rest of the dispensing cartridge through the thickened hinge portion from the blocked state to the unblocked state.

In one embodiment, the piercing mechanism is adjacent the cover portion and is biased against the blocking member when the blocking member is in the blocked state and the dispensing cartridge is in the closed state. In another embodiment, the dispensing cartridge includes a cap portion that is positioned axially adjacent the cover portion when in the closed state forming an interface therebetween. An outer surface of the cap portion corresponds to an outer surface of the cover portion such that there is a substantially flush transition across the interface formed therebetween when the dispensing cartridge is in the closed state and the blocking member is in the unblocked state. This flush transition is generally parallel to the axis along which the dispensing cartridge slides relative to the outer shell.

In one embodiment, when the blocking member is in the blocked state, the outer surface of the cover portion is spaced outward from the outer surface of the cap portion at the interface when the dispensing cartridge is in the closed state.

In one embodiment, a transition portion between the cover portion and the rest of the outer shell is in a state of outward bending when the blocking member is in the blocked state and the dispensing cartridge is in the closed state.

In one embodiment, the piercing member and the blocking member are configured such that actuation of the piercing member causes the blocking member to rotate at least 75 degrees about the thickened hinge portion as the blocking member transitions from the blocked state to the unblocked state.

In one embodiment, the blocking member remains in the unblocked state after being transitioned to the unblocked state. In such an embodiment, the thickened hinge portion is configured as an over-center arrangement.

In one embodiment, the piercing mechanism extends into the access opening when the blocking member is in the unblocked state and the dispensing cartridge is in the closed state.

In one embodiment, a groove surrounds the blocking member. The thin web forms the bottom of the groove.

In one embodiment, the dispensing cartridge includes a sidewall that defines the access opening. The piercing mechanism is biased against an outer surface of the sidewall when the dispensing cartridge is in the open state and is removed from the access opening. The cover portion flexes outward and away from the sidewall of the dispensing cartridge as the piercing mechanism transitions from extending into the access opening to being biased against the outer surface of the sidewall.

In one embodiment, the piercing mechanism extends into the access opening in the closed state with the blocking member in the unblocked state.

In one embodiment, a method of opening a container comprising an outer shell and a dispensing cartridge carried within the outer shell is provided. The method includes actuating a piercing member along a piercing axis to transition a blocking member from a blocked state relative to an access opening of the dispensing cartridge to an unblocked state relative to the access opening, the blocking member covering a greater portion of the access opening in the blocked state than in the unblocked state such that larger objects can pass through the access opening when the blocking member is in the unblocked state than when in the blocked state; and squeezing the outer shell along a compression axis to disengage a catch arrangement between the outer shell and the dispensing cartridge along an expansion axis that is non-parallel with the compression axis.

The method further includes, in one form, axially pulling the dispensing cartridge along a sliding axis that is non-parallel to the compression and expansion axes. In one embodiment, the piercing axis is generally parallel to the expansion axis.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
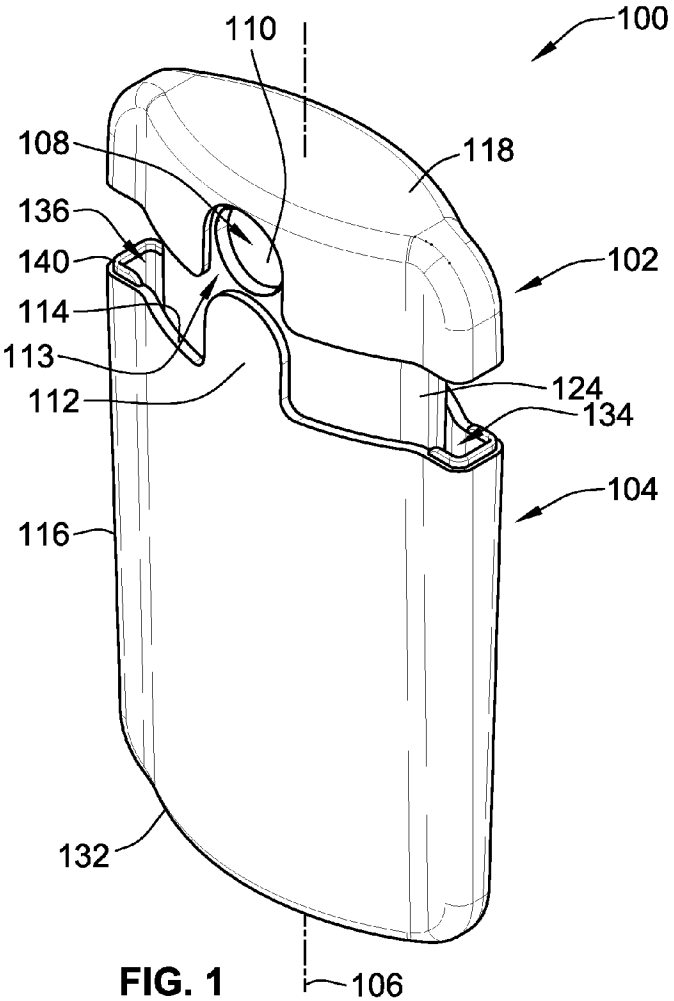
FIG. 1 is a perspective illustration of a front of an embodiment of a container in an open state.

Turning now to FIG. 1, a container 100 according to a first embodiment of the invention is illustrated. The container 100 is illustrated in an open state such that content stored therein can be accessed therefrom. The container 100 of this embodiment is constructed to be child resistant. To be child resistant according to this embodiment, the container requires two separate actions be performed to open the container 100 (i.e. transition the container 100 to the open state). In this embodiment, the container requires a user to laterally squeeze one portion of the container 100 while axially pulling on a second portion of the container 100 along an axis 106 that is different than the axis 164 along which the container is being squeezed (see FIG. 9). This operation will be more fully described below.

The container 100 generally includes a dispensing cartridge 102 that is axially slidable within an outer shell 104. The dispensing cartridge 102 and outer shell 104 axially slide relative to one another along sliding axis 106 between the open state (illustrated in FIGS. 1 and 2) and a closed state (illustrated in FIGS. 3 and 4).

With reference to FIG. 1, the container 100 is in the open state such that an access opening 108 of the dispensing cartridge is exposed to provide access to the storage cavity 110 of the dispensing cartridge 102.

Figure 3:
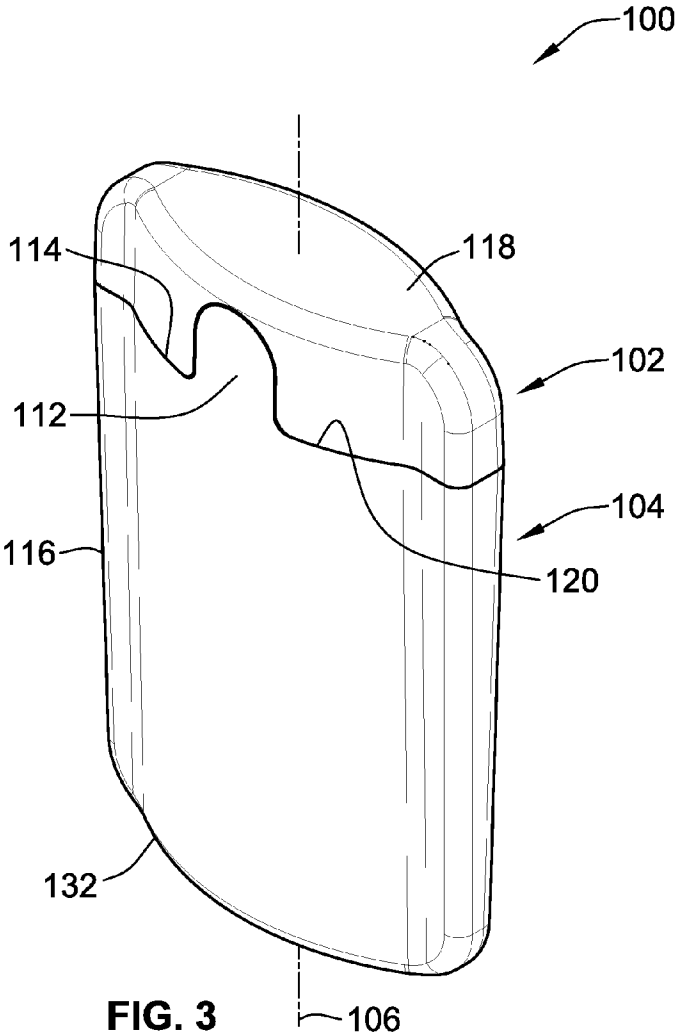
FIG. 3 is a front perspective view of the container of FIG. 1 in a closed state.
Figure 5:
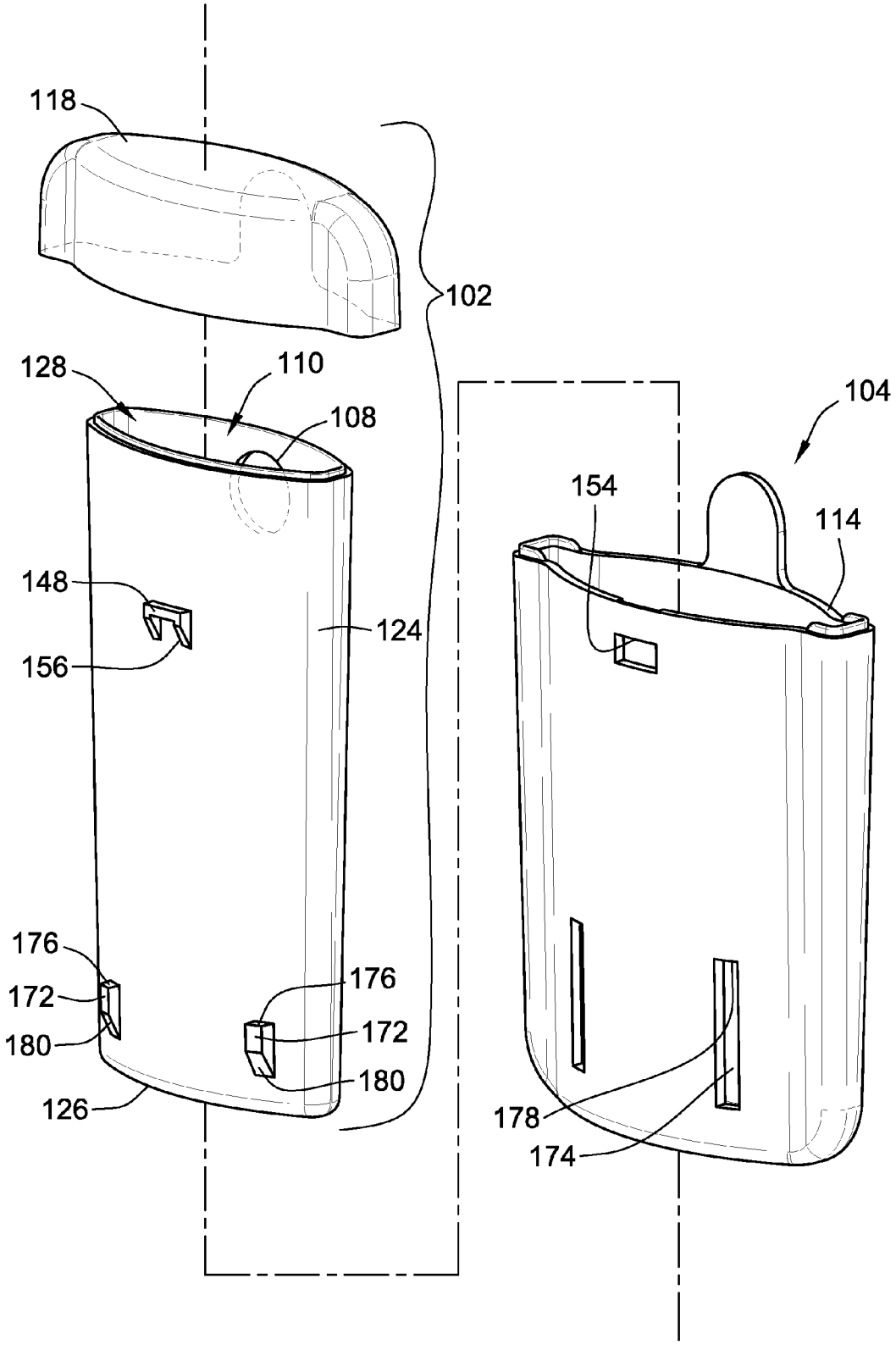
FIG. 5 is a perspective illustration of the container of FIG. 1.

With reference to FIG. 3, the outer shell 104 includes a cover portion 112 that overlaps and covers access opening 108 of the dispensing cartridge 102. As such, in this arrangement illustrated in FIG. 3, the container 100 is in the closed state. More particularly, in this state, access is not permitted to the storage cavity 110. With reference to FIG. 1, the cover portion 112 forms a portion of a distal end portion 114 of a side wall portion 116 of the outer shell 104 that is axially projecting. In the illustrated embodiment, the cover portion 112 is generally hump-shaped with a curved peripheral portion/surface. The cover portion 112 mates with a corresponding cavity of the receiving location 113 of the dispensing cartridge 102. In the particular embodiment, the receiving location 113 that axially receives the cover 112 is formed in a cap portion 118 of the dispensing cartridge 102. When the cover portion 112 is received in receiving location 113, access to storage cavity 110 is prevented.

As further illustrated in FIG. 3, the outer surface of the outer shell 104 corresponds to an outer surface of the cap portion 118 such that when the distal end portion 114 of the side wall axially abuts or substantially axially abuts the cap portion 118 there is a substantially flush transition across the parting line 120 formed therebetween with no or a limited gap (i.e. less than 0.10 inches and preferably less than 0.05 inches).

The container 100 need not include a particular structure that provides the cover portion 112. Alternatively, the side wall portion 116 itself could act as a cover portion and distal end 114 could be substantially flat without the cover portion 112 extending axially therefrom.

The dispensing cartridge 102 is generally formed from a pocket portion 124 and cap portion 118. The pocket portion 124 (also referred to as a pocket member) in the illustrated embodiment is what houses the product stored within the container. More particularly, the pocket portion 124 forms the storage portion of the dispensing cartridge 102. As such, the lower end 126 of the pocket portion 124 is closed in this embodiment. As such, when the dispensing cartridge 102 slides axially relative to the outer shell 104, in this embodiment, the product stored within the container 100 also moves relative to outer shell 104 along sliding axis 106.

The cap portion 118 is used to generally close off an open, opposite, end 128 of the pocket portion 124 formed by the distal end of the generally annular sidewall of the pocket portion 124. This open end 128 is on the opposite end of the pocket portion 124 as the closed lower end 126. This open end 128 allows for commercial filling of the pocket portion 124 with product. Once the pocket portion 124 is filled with product, the cap portion 118 can be axially attached to the pocket portion 124 proximate the open end 128. The cap portion 118 will substantially close the open end 128 of pocket portion 124. At this time, the only access to the storage cavity 110 formed by the cap portion 118 and pocket member 124 is through access opening 108. However, access opening 108 is preferably smaller in cross sectional area than open end 128 such that only a limited amount of product can be dispensed from the pocket portion 124 when the container 100 is in an open state, but still making it easy for bulk loading of the pocket portion 124 when the cap portion 118 is removed.

With regard to the access opening 108, the opening 108 in the illustrated embodiment provides access to the storage cavity 110 in a direction that is generally perpendicular to the axial length of the pocket portion 124 and is generally perpendicular to the access direction into the pocket portion 124 through open end 128. Access into the open end 128 is generally parallel with the sliding axis 106 while the access through access opening 108 is generally perpendicular to sliding axis 106.

The cap portion 118 may be affixed to the end portion of pocket portion 124 proximate the open end 128 such as by welding, adhesives, mechanical locking or other means. Further in other embodiments, the cap portion 118 and pocket portion 124 could be formed as a single piece of material, not two separate components together.

With reference to FIG. 1, the outer shell 104 has a generally closed bottom 132 from which side wall portion 116 extends towards distal end 114. The distal end 114 defines an opening 134 that provides access to an internal cavity 136 of the outer shell 104. The dispensing cartridge 102 extends axially out of the outer shell 104 through opening 134.

The dispensing cartridge 102 slides axially along sliding axis 106 relative to outer shell 104 between the open and closed states as noted above. The cap portion 118 will axially abut the distal end 114 when the dispensing cartridge 102 is in the closed state (see FIG. 3).

The distal end 114 of outer shell 104 includes a pair of mating flanges 140 that are axially received into the cap portion 118 in the closed state. The mating flanges 140 provide additional stability to the cap portion 118 when the cap portion 118 is in the closed state. The engagement between the mating flanges 140 and the cap portion 118 provide lateral support that assists in maintaining the position of the cap portion 118 relative to the outer shell 104 in the closed state.

The container 100 is configured to be child resistant. As such, this embodiment of the container 100 requires multiple steps or actions to transition the container 100 from a closed state to the open state.

Figure 2:
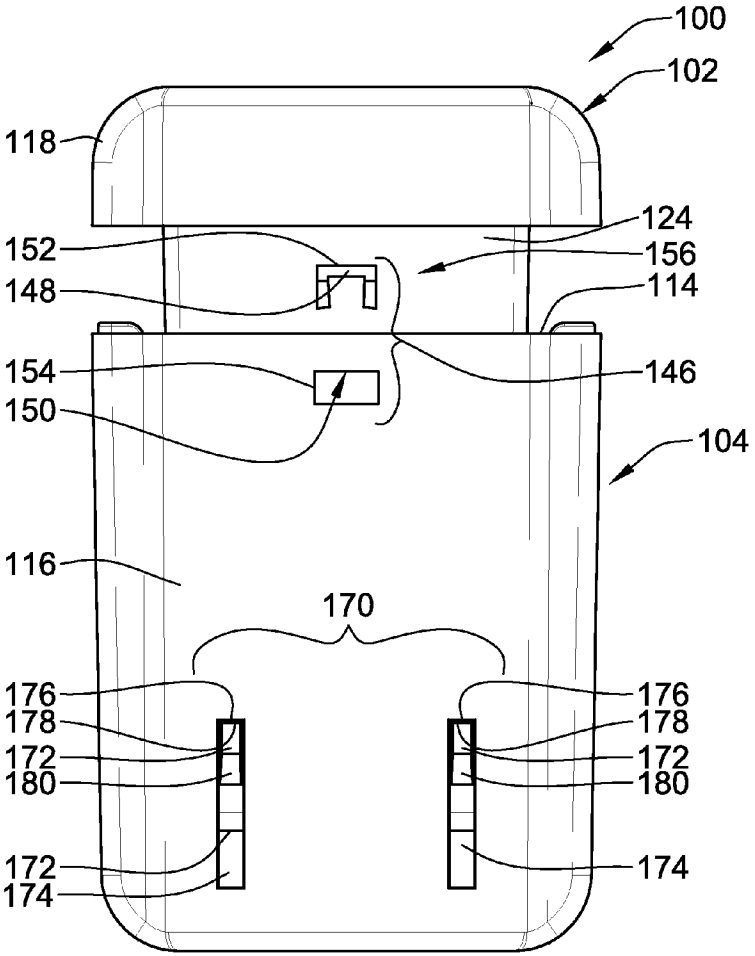
FIG. 2 is a rear profile view of the container of FIG. 1 view.
Figure 4:
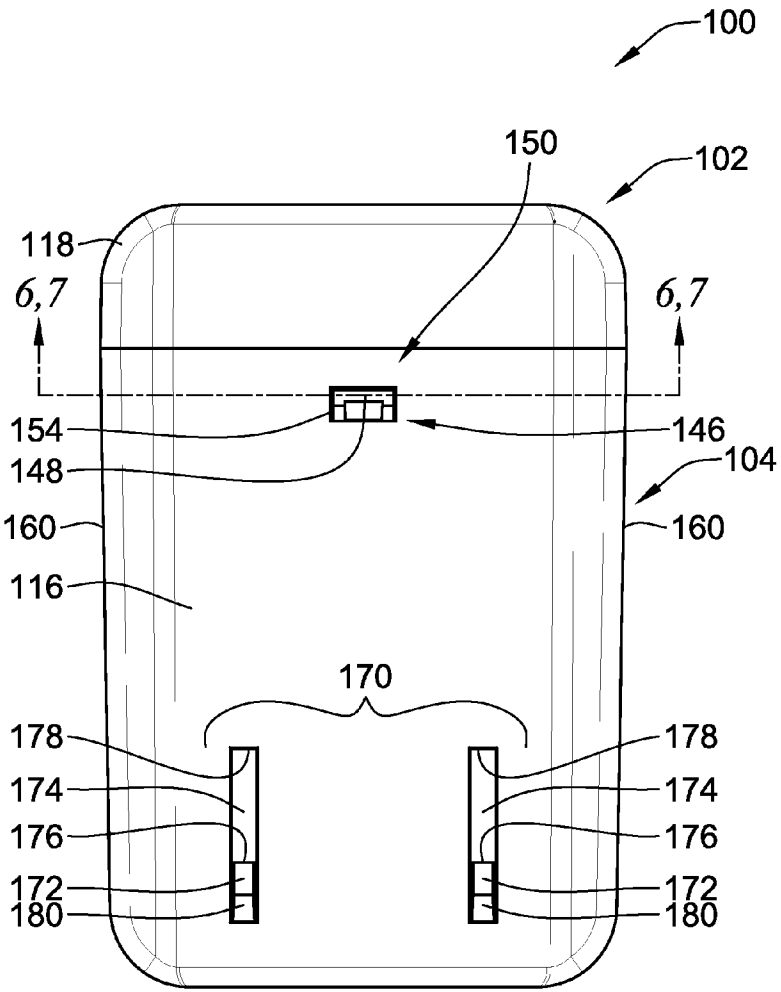
FIG. 4 is a rear profile view of the container of FIG. 1 in a closed state.

With references to FIGS. 2 and 4, the container 100 includes a cooperating catch arrangement 146 operably interposed between the dispensing cartridge 102 and the outer shell 104 to selectively fix the dispensing cartridge 102 in the closed state. The cooperating catch arrangement 146 includes a pair of cooperating catches 148, 150 that engage to maintain the container 100 in a closed state. The cooperating catch arrangement 146 is transitional between a locked state (illustrated in FIGS. 6 and 8) and an unlocked state (illustrated in FIGS. 7 and 9).

In this embodiment, the first catch portion 148 forms part of the dispensing cartridge 102 and is moved therewith during transitions between the open and closed states. The second catch portion 150 forms part of the outer shell 104 and is moved therewith during transitions between the open and closed states. In the illustrated embodiment, the first catch portion 148 is a radially outward extending projection. The radially outward extending projection includes an abutment 152 that axially faces cap portion 118. The abutment 152 and first catch portion 148 extend radially outward from an outer surface of the pocket portion 124. The second catch portion 150 is in the form of a slot formed through side wall portion 116 of the outer shell 104. The slot forms an abutment 154 that axially faces closed bottom 132 that mates with the abutment 152 of the first catch portion 148 when the container 100 is in a locked state.

The first catch portion 148 includes a ramped portion 156 that is provided by a pair of canted surfaces. The canted surfaces extend radially outward from the outer surface of the pocket portion 124 when transitioning in a direction extending towards the cap 118. These ramped surfaces are used to allow the catch portion 148 to pass by the distal end 114 of the outer shell when the container 100 is transitioned from the open state to the closed state. More particularly, as the dispensing cartridge 102 is axially slid into the outer shell 104 the ramped surfaces of the first catch portion 148 will radially bias the side wall portion of the outer shell 104 radially outward to allow the first catch portion to pass by the distal end 114.

Once the first catch portion 148 is inserted into the second catch portion 150 such that abutments 152, 154 axially engage one another, container 100 will be in the locked state.

The side wall portions 116 of the outer shell 104 are preferably convex in cross section such that they are narrower in the thickness direction closer to the edge portions 160 and wider at the center portion substantially midway between the edge portions 160. More particularly, the outer surface of the side wall portions 116 is curved and convex. This arrangement promotes flexure of the side wall portions 116 radially outward when the compression forces 162 (illustrated in FIG. 9) are applied to the edge portions 160 during the unlocking process. This curved or bowed construction allows the compression of the edge portions 160 along the compression axis 164 to create a radially outward directed force on the side wall portions 116.

With reference to FIGS. 6-9, to unlock the cooperating catch arrangement 146, the user applies a squeezing pressure to the side portions 160 (or edges) of the outer shell 104. The squeezing pressure is illustrated as arrows 162 in FIGS. 7 and 9. The squeezing pressure 162 is applied along compression axis 164. Due to the deformation of the outer shell 104 along the compression axis 164, the side wall portions 116 of the outer shell 104 flex radially outward along a second axis 166 (also referred to as an expansion axis). This expansion causes the thickness T of the outer shell to be greater than when the outer shell 104 is in a relaxed state. As the outer shell, and particularly the side wall portions thereof, flex radially outward, the first catch portion 148 will radially disengage from the second catch portion 150. More particularly, the first catch portion 148 will be positioned radially inward from the second catch portion 150 along expansion axis 166 such that there is no axial interference. As such, the dispensing cartridge 102 can be axially slid to the open state.

Figure 8:
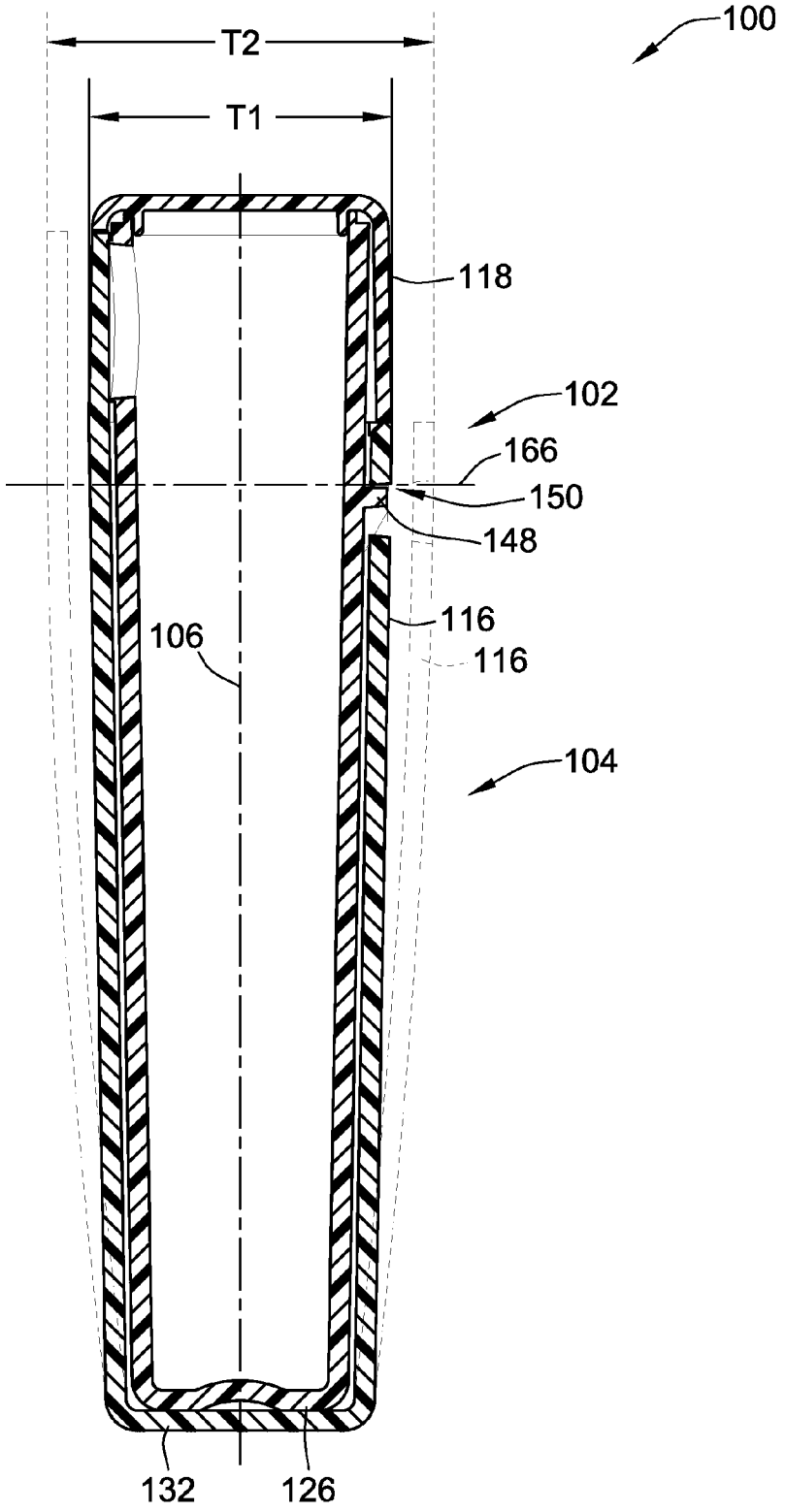
FIG. 8 is a cross-sectional illustration of the container of FIG. 1 shown in both the relaxed/locked and compressed/unlocked states.
Figure 9:
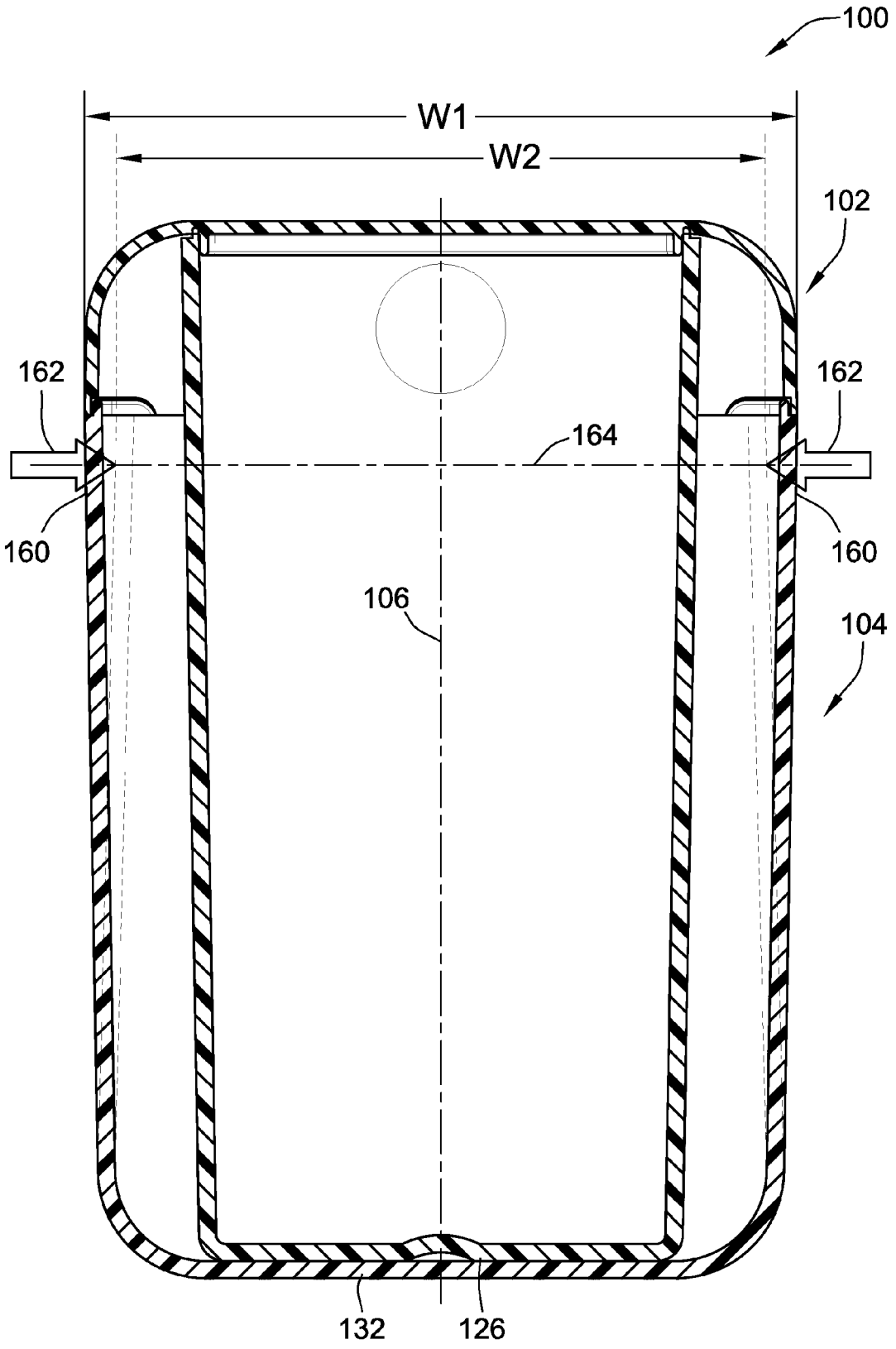
FIG. 9 is a cross-sectional illustration of the container of FIG. 1 shown in both the relaxed/locked and compressed/unlocked states.

FIGS. 8 and 9 illustrate the radially outward flexing of the outer shell 104 when the squeezing pressure 162 is applied to the edge portions 160 of the outer shell. The solid lines in FIGS. 8 and 9 illustrate the outer shell 104 in a relaxed state. The dashed lines illustrate the outer shell 104 in the deformed state. As can be seen in FIGS. 8 and 9, the width w of the outer shell 104 is reduced proximate the application location of pressures 162. This causes the side walls portions 116 to flex radially outward to make the thickness t of the outer shell 104 greater.

Again, as shown in FIG. 8, when the side wall portions 116 of the outer shell 104 are flexed radially outward due to the squeezing pressure 162, the general position of the first catch portion 148 remains the same relative to the expansion axis 166 while the second catch portion 150 is flexed radially outward such that the first and second catch portions 148, 150 no longer overlap or have a substantially similar position along axis 166. Therefore, the axial interference therebetween generally along axis 106 locking the dispensing cartridge 102 in the outer shell 104 no longer exists allowing a user to axially slide the dispensing cartridge 102 relative to the outer shell 104 to transition the container 100 to the open state. When the side wall portions 116 are flared or flexed radially outward such that the cooperating catch portions no longer interfere with one another the container is generally is in an unlocked state.

Figure 6:
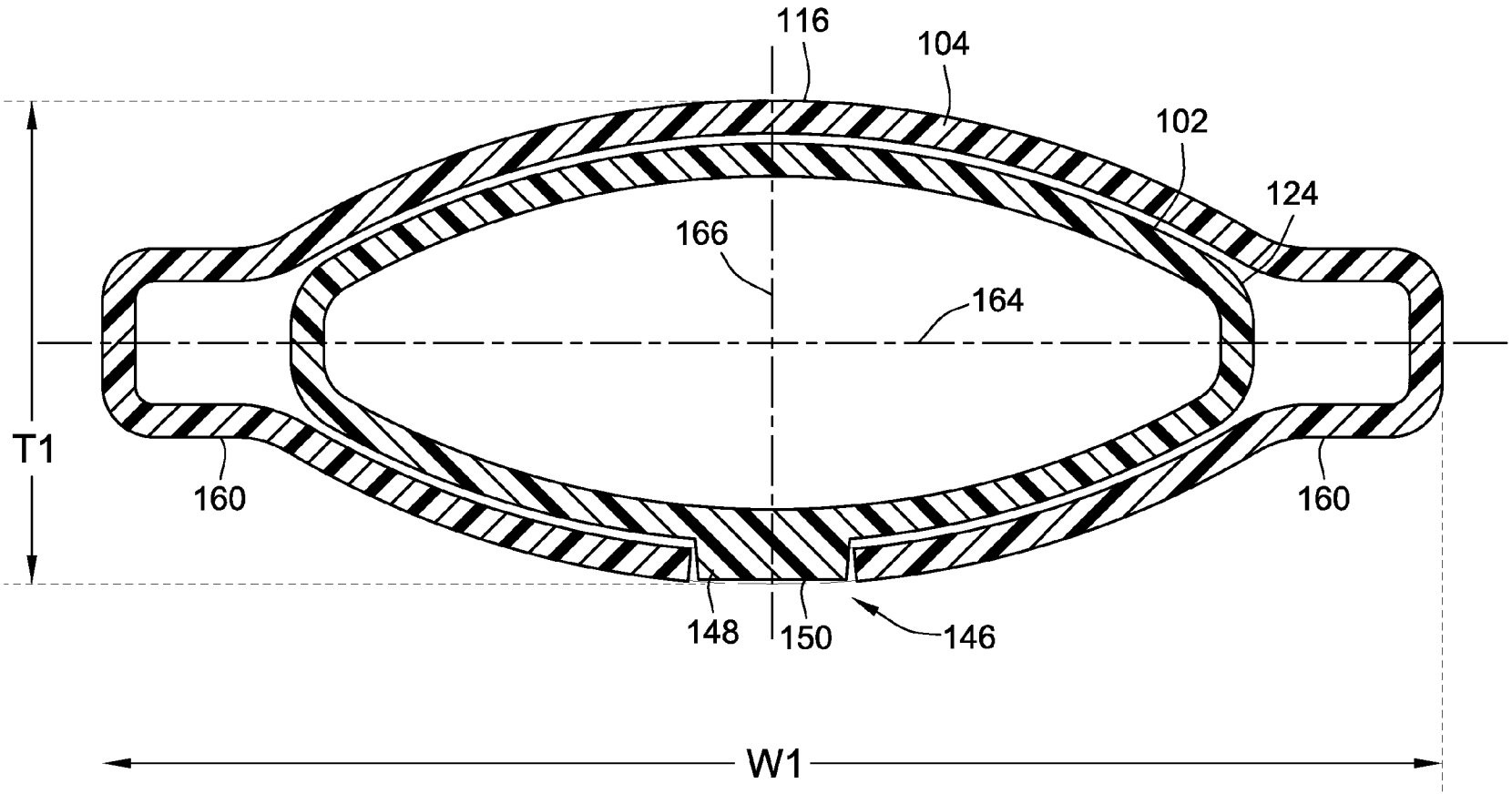
FIG. 6 is a cross-sectional illustration of the container of FIG. 1 in a relaxed state.

FIG. 6 is a cross sectional illustration of the container 100 in the locked state with the first catch portion engaging the second catch portion. At this point the outer shell 104 has not been deformed. As such, the cooperating catch arrangement is in the locked state.

Figure 7:
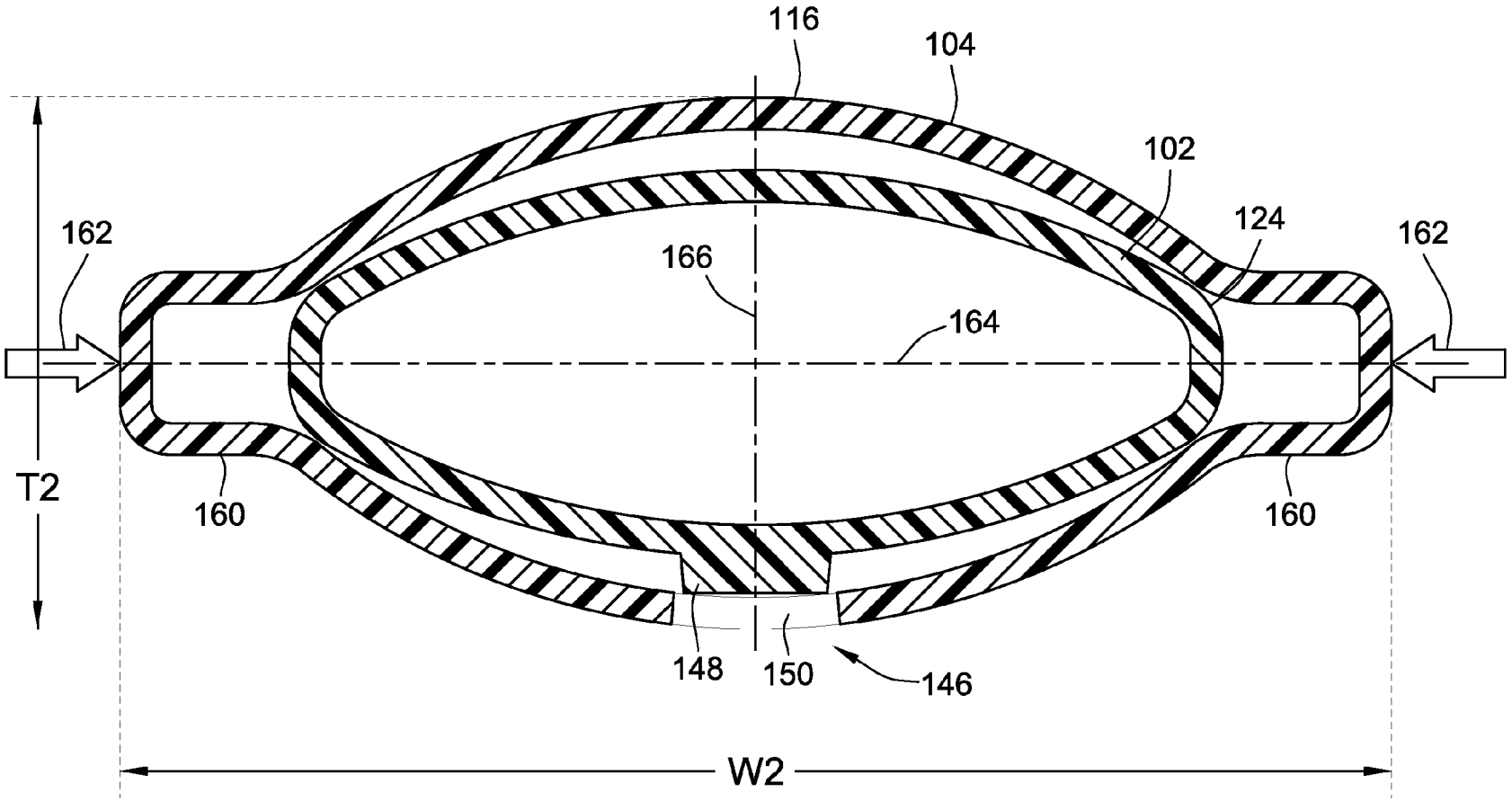
FIG. 7 is a cross-sectional illustration of the container of FIG. 1 in a compressed state.

With reference to FIG. 7 the squeezing pressure has been applied to the edge portions 160 and the width of the outer shell 104 is generally reduced along the compression axis 164.

To prevent the dispensing cartridge 102 from being undesirably fully withdrawn from the outer shell 104 when transitioning between the open and closed states, the container 100 includes a stop arrangement 170 that limits the axial travel of the dispensing cartridge 102 relative to the outer shell 104. The container 100 is preferably configured such that the stop arrangement 170 operates even when the outer shell 104 is flexed due to compressive forces applied along the compression axis 164.

The stop arrangement 170 of the illustrated embodiment includes a pair of cooperating abutments. Each pair of cooperating abutments are generally identical. The cooperating abutments of the illustrated embodiment are provided by a radially outward extending abutment projection 172 that axially slides within an axially extending slot 174. The abutment projection 172 includes an abutment surface 176 that will abut a corresponding abutment surface 178 defined by an end of slot 174 at the maximum outward displacement of the dispensing cartridge relative to the outer shell 104.

The abutment projection 172 preferably includes a tapered surface 180 that assists in initial insertion of the dispensing cartridge 102 within outer shell 104 during assembly.

In an alternative embodiment, the slots 174 need not extend entirely through the side walls portions 116 of the outer shell 104. Instead, the slots could be formed in an inner surface of the outer shell 104. Alternatively, the slots and projections could be reversed such that the slots are formed by the dispensing cartridge 102 and the projection is provided by the outer shell 104. Further yet, the stop arrangement 170 could be provided by a pair of radially extending projections rather than a projection and a slot as illustrated. Further yet, the projections and slots could be provided by radially extending shoulders or shelves formed by these facing surfaces (outer, inner, of the dispensing cartridge 102 and outer shell 104).

While the cooperating catch arrangement 146 is illustrated as a radially outward extending projection 148 and a slot formed in the outer shell 104, other arrangement could be provided, such as those discussed relating to the stop arrangement 170.

Therefore, to operate the container 100, a user will squeeze the outer shell 104 along the compression axis 164 to deform the outer shell 104. This deformation along axis 164 will cause corresponding deformation along expansion axis 166, disengaging the cooperating catch arrangement 146. Then, the user can pull on the dispensing cartridge 102 to translate the dispensing cartridge 102 relative to the outer shell 104. This will transition the dispensing cartridge 102 to the open state such that the access opening 108 is no longer covered by the cover portion 112 of the outer shell 104. At this point, the stop arrangement 170 will also limit the axial displacement of the dispensing cartridge 102 relative to the outer shell 104. This will prevent complete removal of the dispensing cartridge 102 from the outer shell 104.

While the prior embodiment illustrated a dispensing cartridge that wholly held the products contained within container 100, alternative embodiments of containers are contemplated. For instance, the dispensing cartridge 102 could merely be an inner sleeve with the primary function of providing a cap/cover and the access opening and the products stored within the outer shell 104. For instance, the dispensing cartridge 102 could strictly be used to provide the access opening 108. Therefore, when the dispensing cartridge 102 is axially translated relative to the outer shell 104, in such an embodiment, the product remains in a fixed axial position relative to the outer shell 104. This arrangement would provide for potentially a cheaper design. In such an arrangement, it would be desired that slots 174 do not extend entirely through the outer shell 104.

Figure 11:
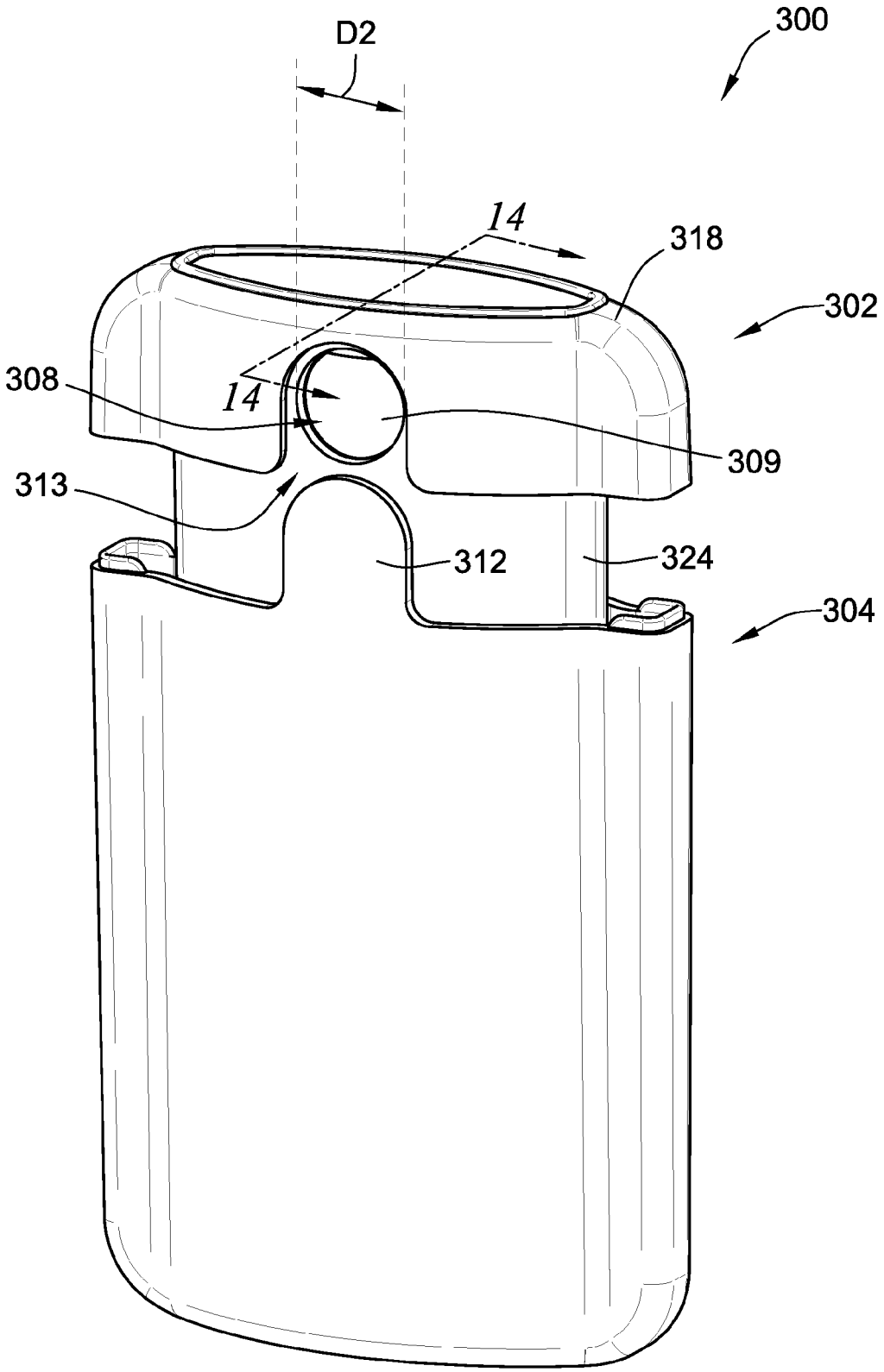
FIG. 11 is a front perspective view of a further embodiment of a container according to the present invention in an open state with the breakaway member in an unbroken state.

FIG. 11 illustrates a further embodiment of a container 300 according to a second embodiment of the present invention. The operation of the container 300 is substantially similar to container 100 and only the differences therein will be focused on in the following discussion.

Figure 12:
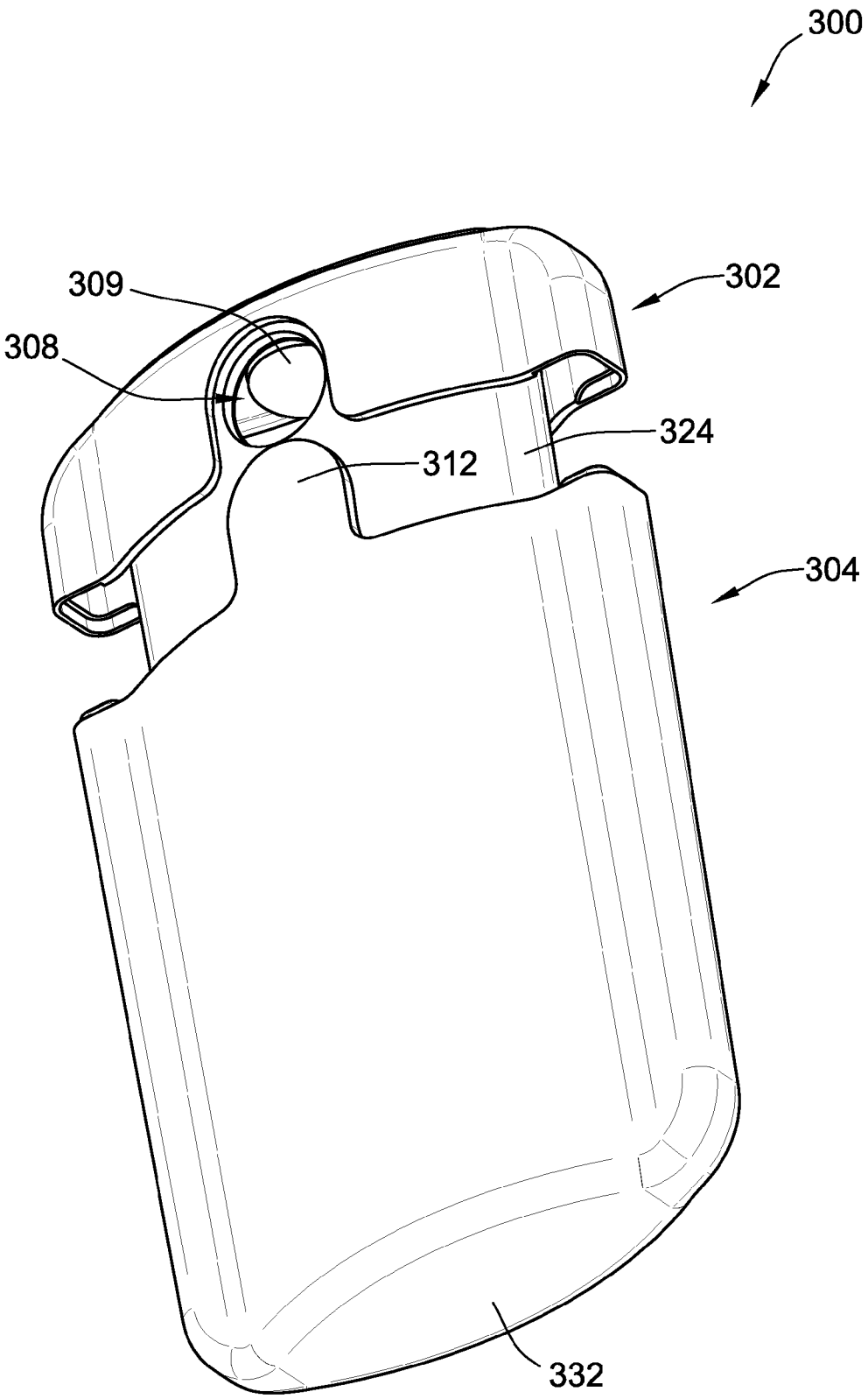
FIG. 12 is a front perspective view of the container of FIG. 11 in an open state with the breakaway member in a pivoted state.

Container 300 includes a dispensing cartridge 302 that is axially received in and slidable relative to outer shell 304. This container 300 differs from the prior embodiments in that the dispensing cartridge 302 and particularly the pocket portion 324 includes a blocking member in the form of breakaway member 309 that closes the access opening 308 until first use of the container 300. FIG. 11 illustrates the access opening 308 being blocked by the breakaway member 309, which is in a blocked state relative to the access opening. FIG. 12 illustrates the breakaway member 309 opened and in an unblocked state such that access opening 308 is clear for product to be dispensed therethrough. More particularly, when the breakaway member 309 is in the unblocked state, larger objects may pass through the access opening than when the blocking member is in the blocked state. This is because in the blocked state the breakaway member 309 covers more of the access opening, if not the entire access opening 308, than when in the unblocked state.

Figure 13:
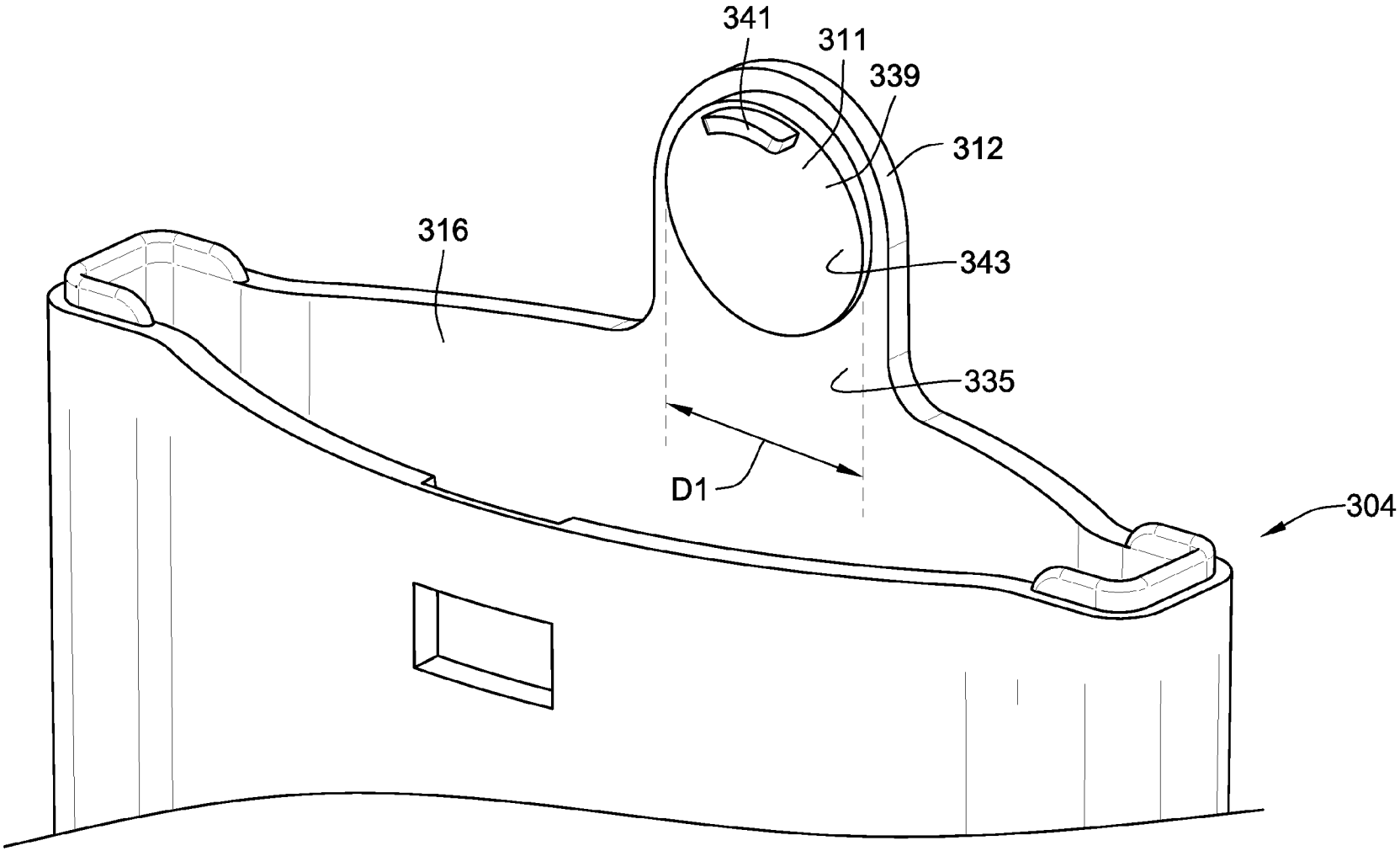
FIG. 13 is a top and rear perspective view of the outer shell of the container of FIG. 11 illustrating the piercing mechanism thereof.

With reference to FIG. 13, the container 300 also includes a piercing mechanism 311 used to pierce or otherwise break the breakaway member 309. More particularly, the piercing mechanism is configured to transition the blocking member, i.e. breakaway member 309, from the blocked state to the unblocked state.

The piercing mechanism 311 extends laterally inward from the cover portion 312 that covers the receiving location 313 of the cap portion 318 as well as access opening 308 when in a closed state.

Figure 14:
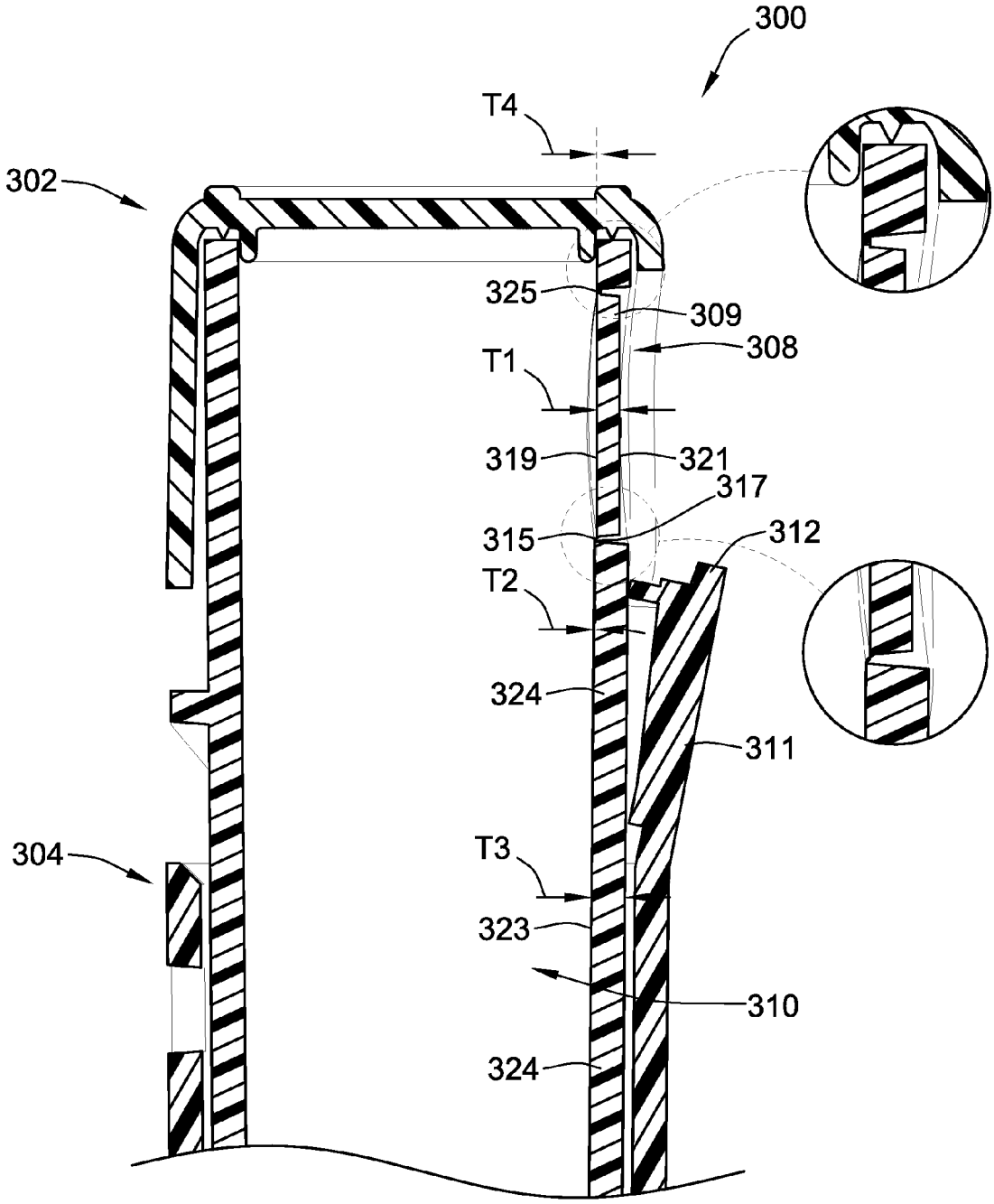
FIG. 14 is a side cross-sectional illustration of the container taken about line 14-14 in FIG. 11.
Figure 15:
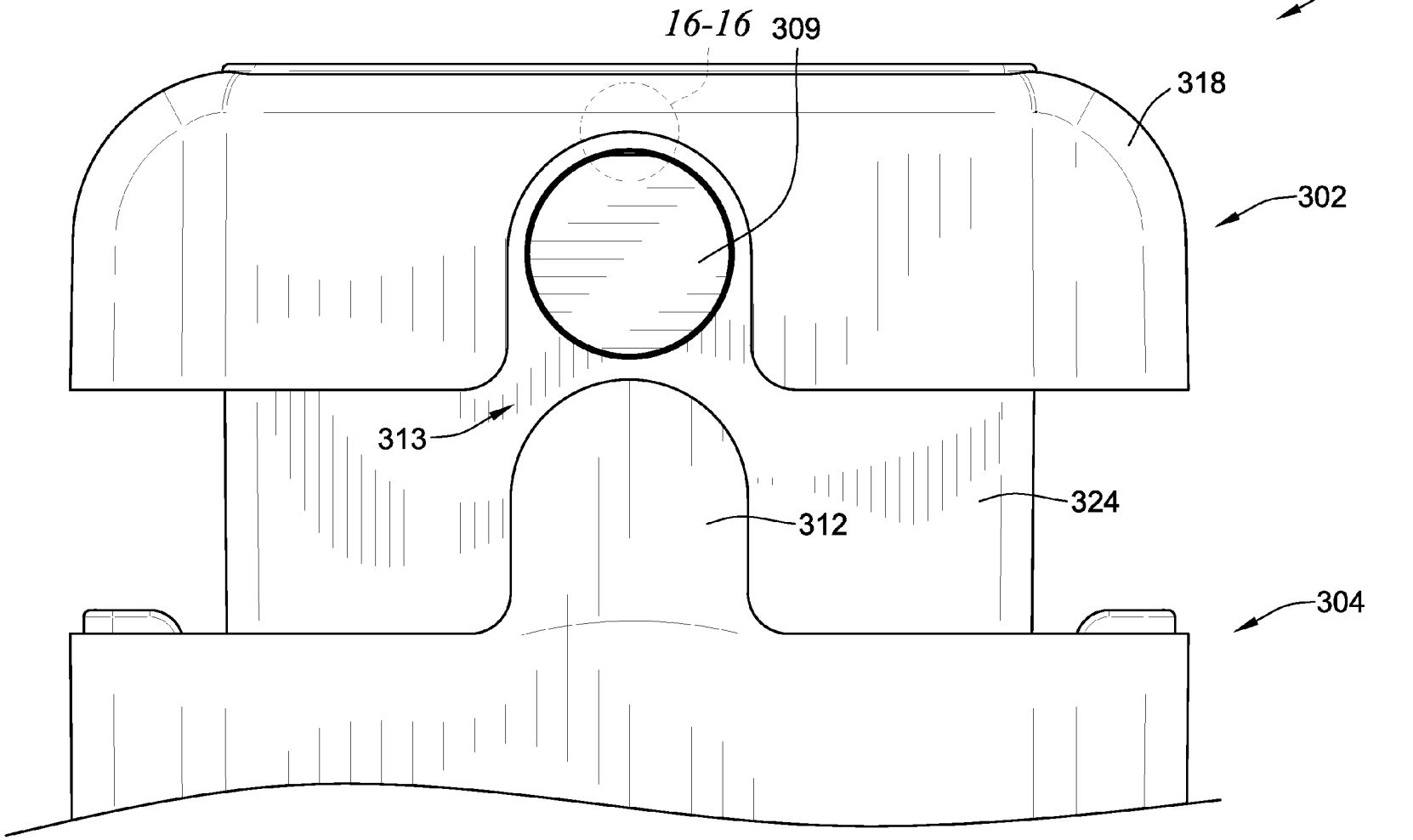
FIG. 15 is a front profile illustration of the container of FIG. 11.
Figure 16:
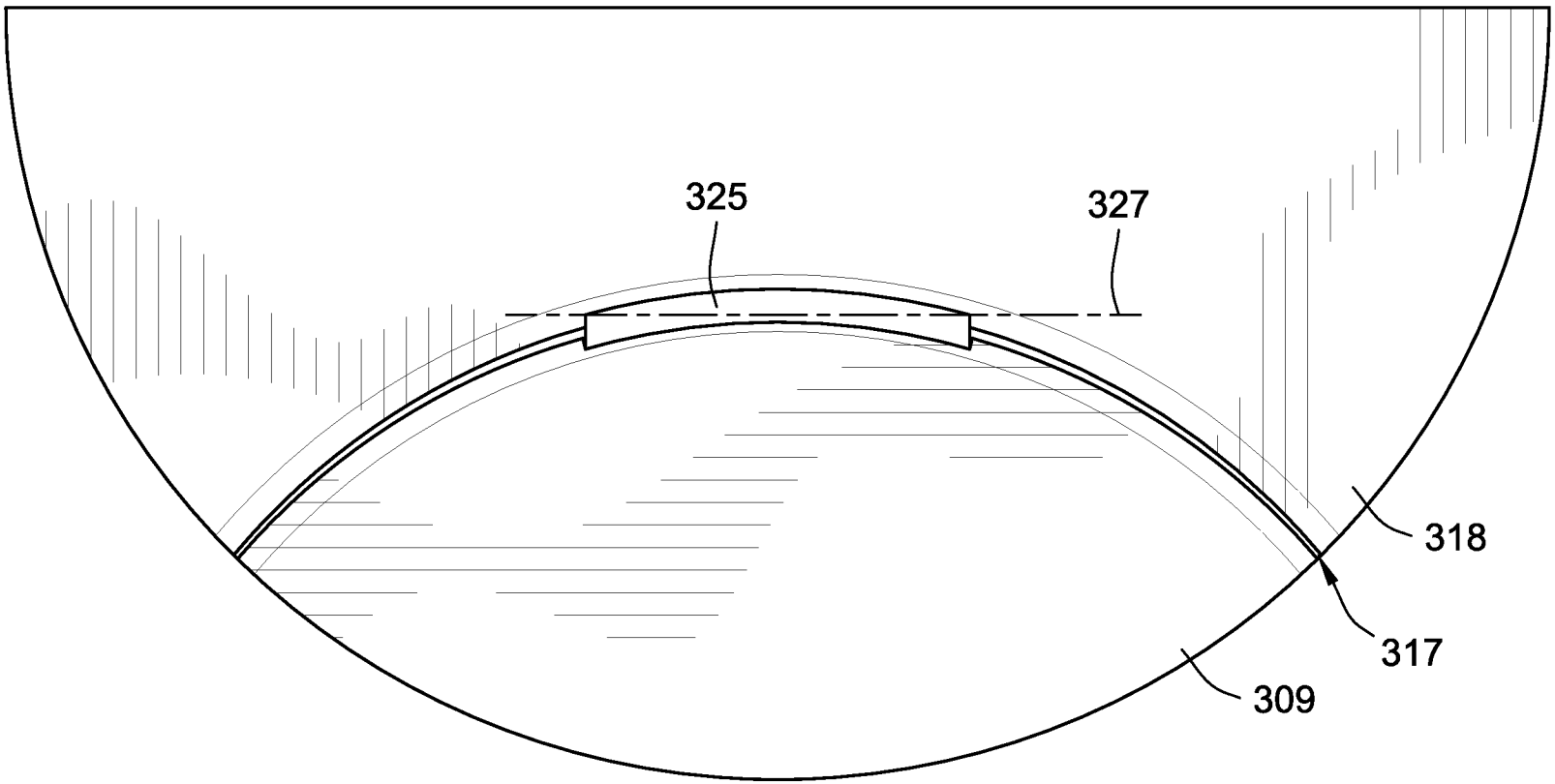
FIG. 16 is an enlarged partial illustration of the container of FIG. 11.

In a preferred embodiment, the breakaway member 309 is integrally formed into the pocket portion 324 and forms a one-piece construction therewith such that it is molded at the same time as the rest of pocket portion 324. With reference to FIG. 14, in the exemplary embodiment, the breakaway member 309 is attached to the rest of the pocket portion 324 by a thin web 315 that circumscribes the breakaway member 309. The thin web 315 and breakaway member 309 seals the dispensing cartridge 302 until broken and also prevents dispensing product through the access opening 308. In one embodiment, the thin web 315 and breakaway member 309 completely prevent passage through the access opening 308.

In the exemplary embodiment, the thickness T1 extending between an inner surface 319 and an outer surface 321 of the breakaway member 309 is significantly greater than the thickness T2 of the thin web 315. The thickness T2 of the thin web 315 is preferably less than 50% of the thickness T1 of the breakaway member 309, more preferably less than 75% of the thickness T1 of the breakaway member 309, and even more preferably less than 85% of the thickness T1 of the breakaway member 309. Further, the thickness T1 of the breakaway member 309 is preferably less than the thickness T3 of the sidewall defining the pocket portion 324 defining the access opening 308. The reduced thickness of the thin web 315 assists in permanently breaking the thin web 315 when it is desired to open the container 300 and access the contents within the dispensing cartridge 302 using, for example, the piercing mechanism 311 and transitioning the breakaway member 309 to the unblocked state, for at least the first time.

An annular groove 317 circumscribes a portion of the breakaway member 309 and has an outward facing mouth. The use of the annular groove 317 assists in locating where the pocket portion 324 will break when pressure is applied by the piercing mechanism 311 to the breakaway member 309. The thin web 315 forms a bottom of annular groove 317.

The inner surface 319 of the breakaway member 309 of the illustrated embodiment is preferably smooth with and continuous with inner surface 323 of the sidewall of the pocket portion 324.

In a preferred embodiment, prior to breakage of thin web 315, the breakaway member 309 and thin web 315 hermetically seals the storage cavity 310 of the dispensing cartridge 302. However, in alternative embodiments, the thin web need not be a continuous web that fully circumscribes the breakaway member 309. Instead, the thin web 315 could be provided by a discontinuous web or a plurality of ribs that extend between the sidewall of pocket portion and the breakaway member 309 but that permits air flow between adjacent ones of the ribs. This arrangement would appear much like a hub and spoke type arrangement. In such an embodiment, the thickness of the ribs could be the same as the thickness of the breakaway member because the voids between the ribs would assist in locating where the container is broken to permit access through the access opening. Finally, a blocking member could be provided by other means such as an adhesively attached member or seal attached to the inner surface of the sidewall of the pocket portion adjacent the access opening.

Figure 17:
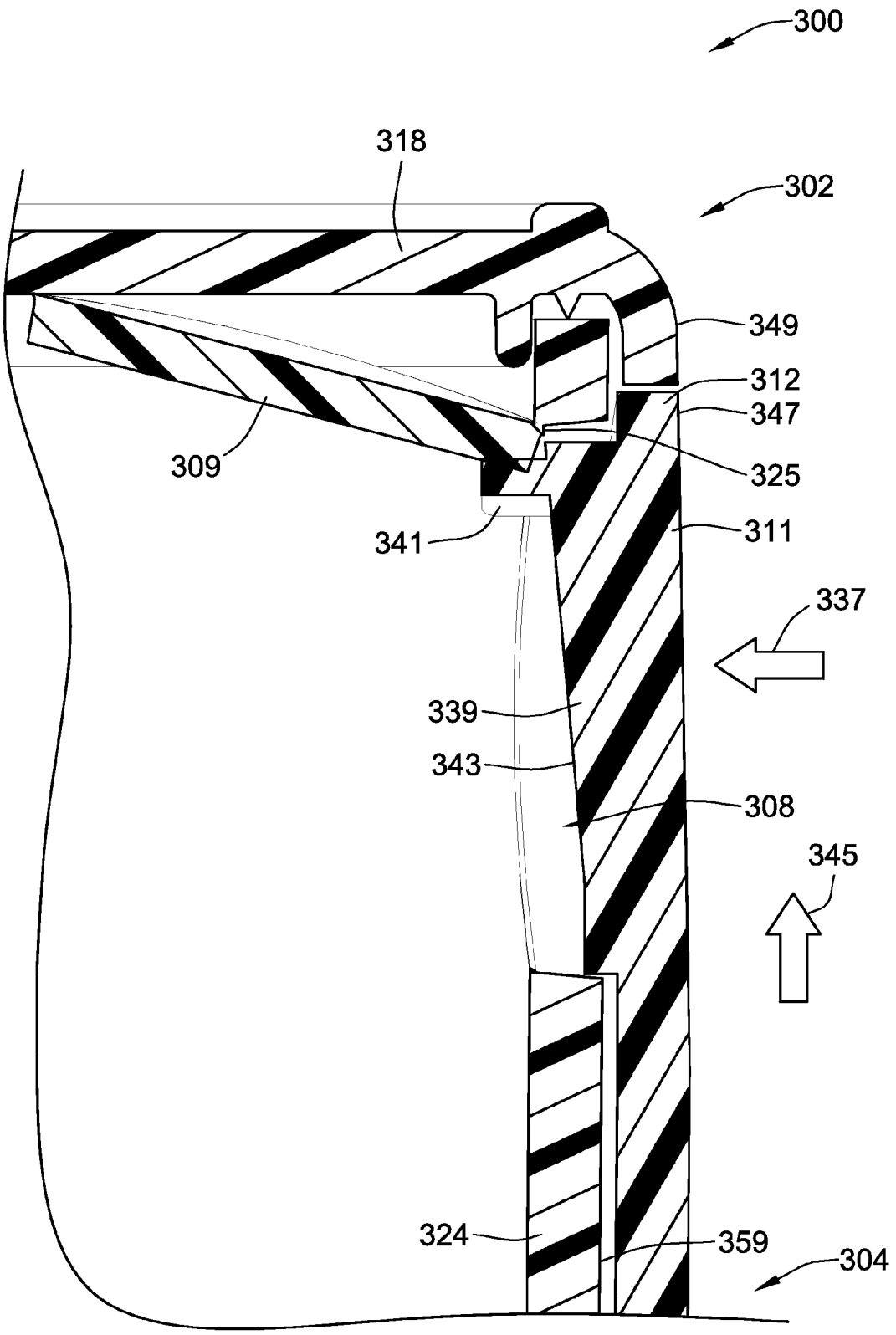
FIG. 17 is a cross-sectional illustration of the container of FIG. 11 with the container in a closed state and the breakaway member in a pivoted state.

With reference to FIGS. 14-17, the thin web 315 includes a thickened hinge portion 325. The thickened hinge portion 325 has a thickness T4 that is greater than thickness T2 of the rest of the thin web 315. Thicknesses T1-T4 are generally parallel to an axis perpendicular to the access opening. As illustrated in FIG. 17, this portion of the thin web 315 does not break and acts as a hinge for pivoting the breakaway member 309 relative to the pocket portion 302 such that breakaway member 309 does not interfere with the access opening 308. Preferably, the thickened hinge portion 325 is configured such that once the thin web 315 has been broken and the breakaway member 309 is in a pivoted state (see FIG. 17), the breakaway member 309 stays in the pivoted and unblocked state and does not transition back toward the blocked state (see FIG. 14). This may be accomplished if hinge portion 325 is configured to provide an over-center arrangement. Further, an additional benefit of the thickened hinge portion 325 is that the breakaway member 309 does not break from the rest of pocket portion 324 and remains attached thereto to avoid mixing the breakaway member 309 with the contents stored within the dispensing cartridge 302.

With reference to FIGS. 13, 14 and 17, the piercing mechanism 311 is configured to transition the breakaway member 309 away from the blocked state (FIG. 14) to the pivoted and unblocked state (FIG. 17) after a user applies laterally inward directed pressure (illustrated by arrow 337 in FIG. 17). This pressure is generally perpendicular to access opening 308. The piercing mechanism 311 extends laterally inward from an inner surface 335 of a sidewall 316 of the outer shell 304. More particularly, the piercing mechanism 311 extends inward towards the dispensing portion 302.

The piercing mechanism 311 of the illustrated embodiment includes a tapered base portion 339 and a contact portion 341. The base portion 339 has a tapered face 343 from which the contact portion 341 projects. The base portion 339 increases in thickness when moving in a direction extending away from the rest of the outer shell 304 illustrated by arrow 345 in FIG. 17, and particularly away from the closed end 332 (FIG. 12) of the outer shell 304.

Once the user has pressed laterally inward on the cover portion 312 and broken the thin web 315, the base portion will extend, at least partly into the access opening 108 when the container 300 is in a locked and/or closed state. As noted above, preferably, the thickened hinge portion 325 is configured to maintain the breakaway member in the pivoted state such that after the initial puncture or breaking of thin web 315, the piercing mechanism 311 can laterally extend into the access opening 308. Preferably, the piercing mechanism 311 can be received laterally into the access opening sufficiently far that the outer surface 347 of the cover portion 312 is substantially flush with the adjacent outer surface 349 of the cap portion 318. As such, the interface or transition between the cover portion 312 and the cap portion 318 is substantially smooth or flush, with only a very limited step therebetween when the container is in the closed state.

Figure 18:
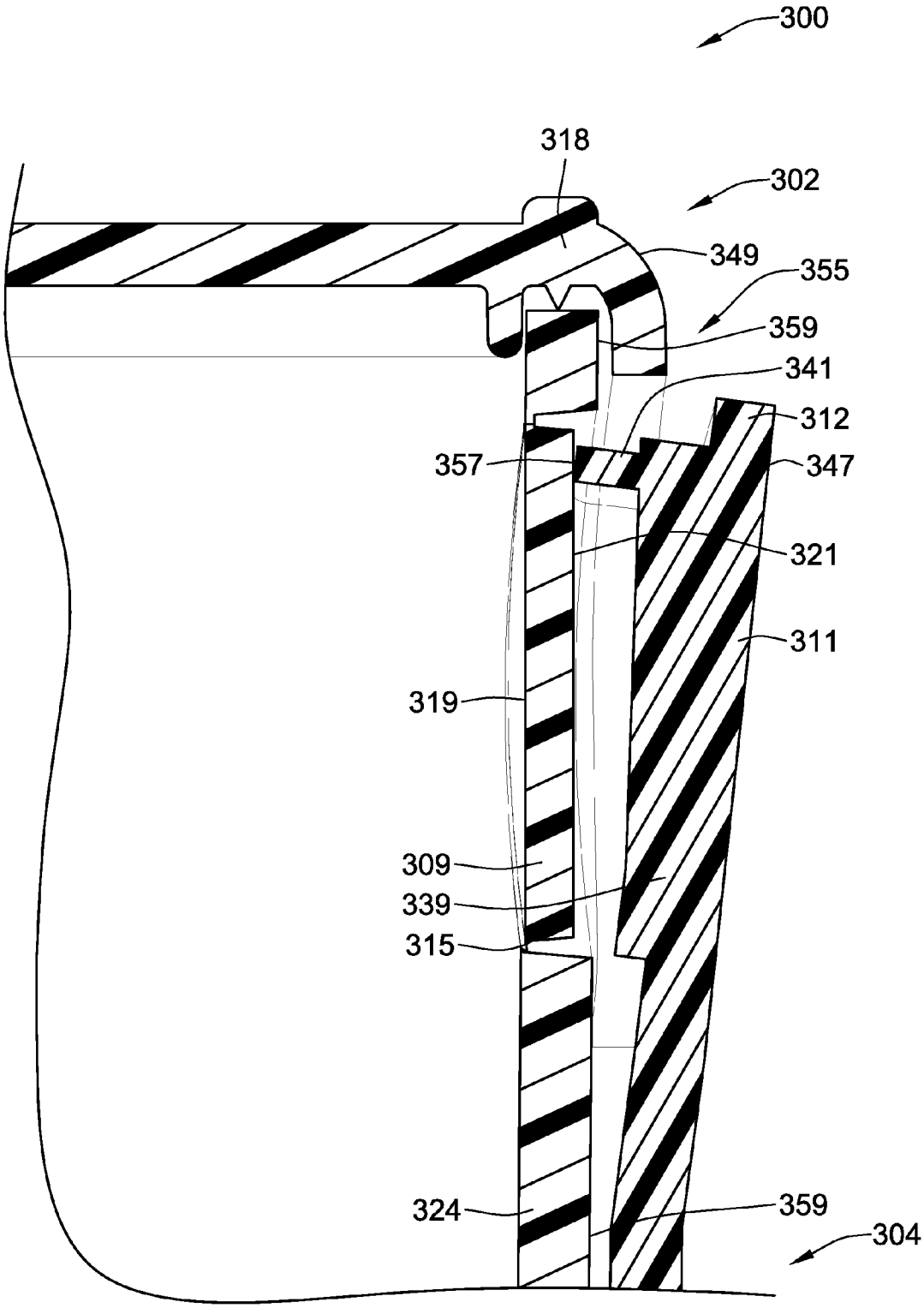
FIG. 18 is a cross-sectional illustration of the container of FIG. 11 with the container in a closed state and the breakaway member in an unbroken state.
Figure 19:
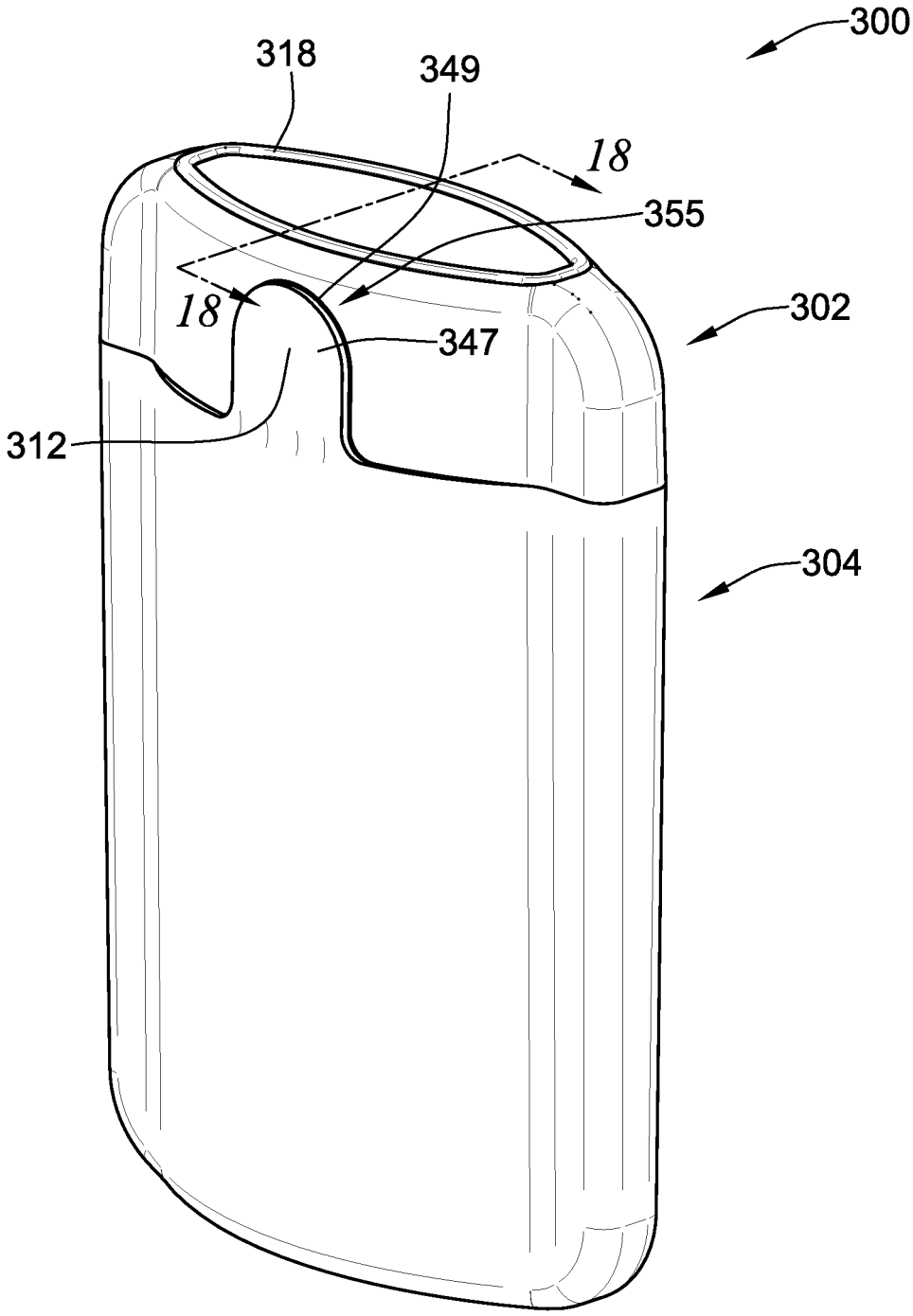
FIG. 19 is a front perspective illustration of the container of FIG. 11 in a closed state with the breakaway member in an unbroken state.

However, as illustrated in FIG. 18, prior to pivoting of the breakaway member 309 to the pivoted position and breakage of the thin web 315, a distal end of the contact portion 341 of the piercing mechanism 311 will rest against the outers surface 321 of the breakaway member 309 when the container is in the closed state. This causes the cover portion 312 to be bent laterally outward. This arrangement provides a visual tamper evidence as a lateral step 355 is formed between the outer surface 347 of the cover portion 312 and the outer surface 349 of the cap portion 318 rather than the flush orientation as illustrated in FIG. 17. In the preferred embodiment, the cover portion 312, as well as a transition portion between the cover portion 312 and the rest of the outer shell 304 is in a state of bending when the breakaway member 309 has not been pivoted such that the distal end 357 is biased against the outer surface 321 of the breakaway member 309 as illustrated in FIG. 18.

The cover portion 312 is preferably configured for auto-closing after the breakaway member 309 has been transitioned to the pivoted state. When the outer shell 304 is transitioned to the closed state (i.e. FIG. 17), the piercing mechanism 311 will automatically nest into the access opening 308 under the preload stored within the cover portion 312 due to the cover portion being flexed laterally outward when the outer shell 304 is not in the closed state relative to the pocket portion 324. This is because the contact piercing mechanism 311 is pressed against the outer surface of the pocket portion 324 in the open state such that the cover portion 312 is flexed radially outward as discussed above.

In a preferred embodiment, the auto-closing feature is also accompanied with an audible clicking sound that provides confirmation to a user that the container 300 is in fact in a closed state.

With reference to FIGS. 11 and 13, the outer periphery of the base portion 339 is shaped to mate with the inner periphery of the access opening 308. Further, the outer diameter D1 of the outer periphery of the base portion 339 is substantially equal to the inner diameter D2 of the inner periphery of the access opening 308. In one embodiment, the base portion 339 is configured to act as a plug and provide a seal within the access opening 308. In some embodiments, the base portion 339 may be slightly oversized such that it must be press-fit into the access opening 308 to further facilitate the sealing action of the base portion 339.

Preferably, the breakaway member 309 pivots at least 75 degrees about hinge 315 and even more preferably at least 90 degrees.

Methods according to the present invention include first transitioning the breakaway member 309 from the blocked state to the unblocked state using the piercing mechanism 311. Then, the user can transition the container 300 from the closed state to the open state as discussed above with regard to container 100. The piercing action is generally applied in along a piercing axis that is perpendicular to the force applied to unlock the outer shell from the dispensing cartridge as well as perpendicular to the axis along which the dispensing cartridge slides relative to the outer shell. The piercing axis is also generally parallel to the expansion axis discussed above.

Figure 10:
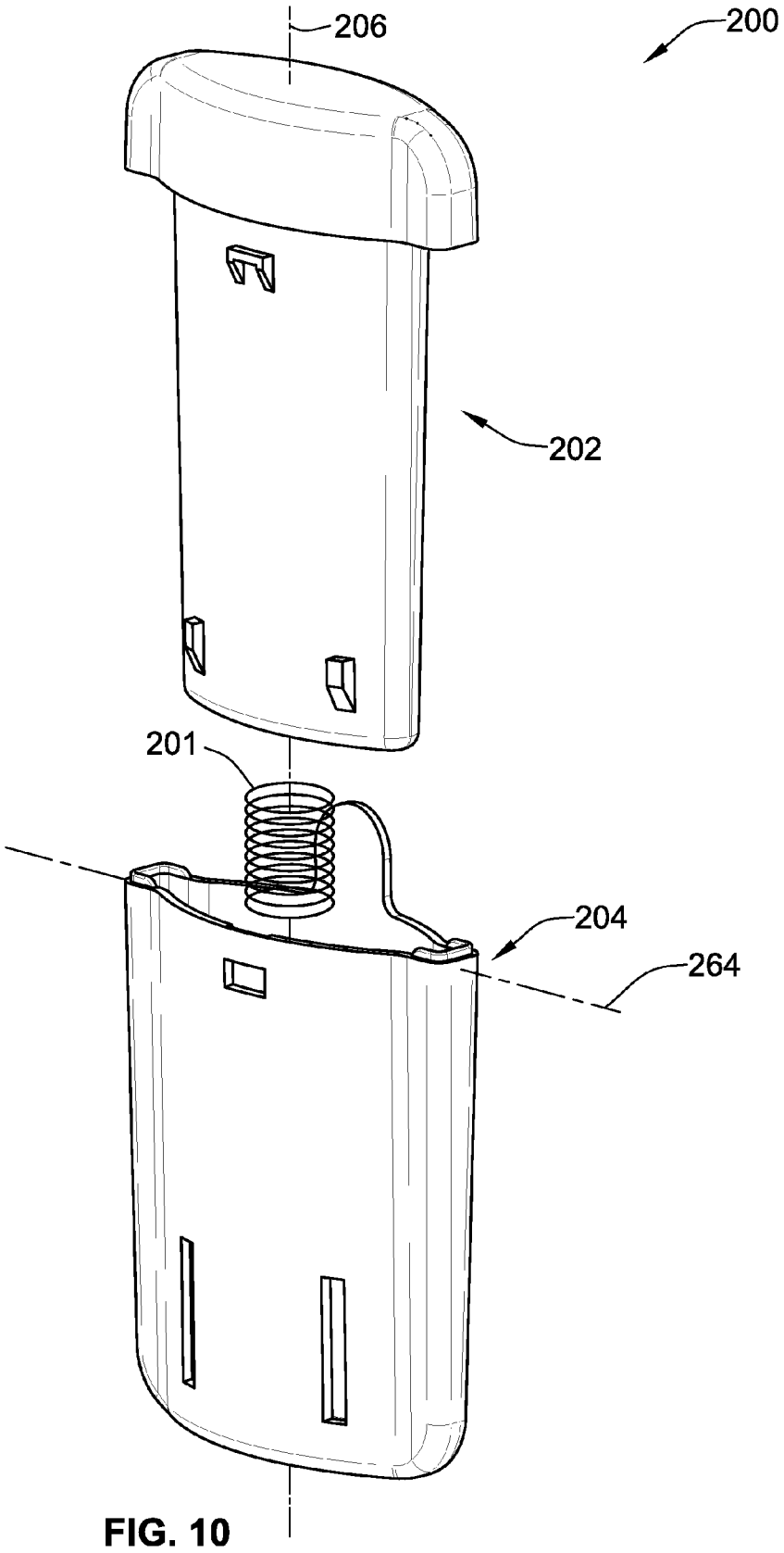
FIG. 10 is a further embodiment of a container in a partially exploded view.

Further embodiments may also be provided. For example, in FIG. 10, in a non-child resistant container, a spring member/biasing member 201 may be operably interposed between the dispensing cartridge 202 and the outer shell 204 such that once the user compresses the outer shell 204 along compression axis 264, the dispensing cartridge 202 will be automatically ejected along axis 206. Notably, this would only require one action to transition the container 200 to an open state. Thus, this would not provide the child resistant characteristics of the prior designs. However, this could be used for products that do not require storage in child resistant containers. For instance, such a container could be used for small candies, gum, etc.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a dispensing cartridge defining a storage cavity and an access opening to the storage cavity;

a blocking member transitionable from a blocked state relative to the access opening to an unblocked state relative to the access opening, the blocking member covering a greater portion of the access opening in the blocked state than in the unblocked state such that larger objects can pass through the access opening when the blocking member is in the unblocked state than when in the blocked state; and an outer shell including a piercing mechanism configured to transition the blocking member from the blocked state to the unblocked state, the dispensing cartridge slidable within the outer shell between a closed state in which a cover portion of the outer shell overlaps the access opening inhibiting access to the storage cavity when the blocking member is in the unblocked state and an open state in which the cover portion of the outer shell overlaps the access opening to a lesser extent to increase access to the storage cavity through the opening when the blocking member is in the unblocked state.

2. The container of claim 1, wherein the blocking member completely prevents passage through the access opening in the blocked state.

3. The container of claim 1, wherein the blocking member is formed as a portion of the dispensing cartridge, the blocking member being attached to the rest of the dispensing cartridge by a thin web of material; wherein when the blocking member is transitioned to the unblocked state for a first time, at least a portion of the thin web of material is permanently broken.

4. The container of claim 3, wherein the thin web of material further includes a thickened hinge portion that is not permanently broken when the blocking member is transitioned to the unblocked state for, at least, the first time.

5. The container of claim 4, wherein the blocking member pivots relative to the rest of the dispensing cartridge through the thickened hinge portion from the blocked state to the unblocked state.

6. The container of claim 1, wherein the piercing mechanism is adjacent the cover portion and is biased against the blocking member when the blocking member is in the blocked state and the dispensing cartridge is in the closed state.

7. The container of claim 6, wherein the dispensing cartridge includes a cap portion that is positioned axially adjacent the cover portion when in the closed state forming an interface therebetween, wherein an outer surface of the cap portion corresponds to an outer surface of the cover portion such that there is a substantially flush transition across the interface formed therebetween when the dispensing cartridge is in the closed state and the blocking member is in the unblocked state.

8. The container of claim 7, wherein when the blocking member is in the blocked state, the outer surface of the cover portion is spaced outward from the outer surface of the cap portion at the interface when the dispensing cartridge is in the closed state.

9. The container of claim 8, wherein a transition portion between the cover portion and the rest of the outer shell is in a state of outward bending when the blocking member is in the blocked state and the dispensing cartridge is in the closed state.

10. The container of claim 4, wherein the piercing member and the blocking member are configured such that actuation of the piercing member causes the blocking member to rotate at least 75 degrees about the thickened hinge portion as it transitions from the blocked state to the unblocked state.

11. The container of claim 4, wherein the blocking member remains in the unblocked state after being transitioned to the unblocked state.

12. The container of claim 11, wherein the thickened hinge portion is configured as an over-center arrangement.

13. The container of claim 1, wherein the piercing mechanism extends into the access opening when the blocking member is in the unblocked state and the dispensing cartridge is in the closed state.

14. The container of claim 1, further comprising:

a cooperating catch arrangement between the outer shell and the dispensing cartridge having a locked state that fixes the dispensing cartridge in the closed state relative to the outer shell and an unlocked state in which the dispensing cartridge is permitted to slide relative to the outer shell from the closed state to the open state; and the cooperating catch arrangement transitionable from the locked state to the unlocked state by resiliently reducing a width of the outer shell along a compression axis to resiliently expand a thickness of the outer shell along an expansion axis to disengage cooperating catch arrangement.

15. The container of claim 3, further comprising a groove surrounding the blocking member, the thin web forming the bottom of the groove.

16. The container of claim 13, wherein the dispensing cartridge includes a sidewall that defines the access opening, the piercing mechanism being biased against an outer surface of the sidewall when the dispensing cartridge is in the open state and is removed from the access opening, the cover portion flexing outward and away from the sidewall of the dispensing cartridge as the piercing mechanism transitions from extending into the access opening to being biased against the outer surface of the sidewall.

17. The container of claim 8, wherein the piercing mechanism extends into the access opening in the closed state with the blocking member in the unblocked state.

18. A method of opening a container comprising an outer shell and a dispensing cartridge carried within the outer shell comprising:

actuating a piercing member along a piercing axis to transition a blocking member from a blocked state relative to an access opening of the dispensing cartridge to an unblocked state relative to the access opening, the blocking member covering a greater portion of the access opening in the blocked state than in the unblocked state such that larger objects can pass through the access opening when the blocking member is in the unblocked state than when in the blocked state;

squeezing the outer shell along a compression axis to disengage a catch arrangement between the outer shell and the dispensing cartridge along an expansion axis that is non-parallel with the compression axis.

19. The method of claim 18, further comprising axially pulling the dispensing cartridge along a sliding axis that is non-parallel to the compression and expansion axes.

20. The method of claim 19, wherein the piercing axis is generally parallel to the expansion axis.

* * * * *